US010774779B2

(12) United States Patent
Yoshimura

(10) Patent No.: US 10,774,779 B2
(45) Date of Patent: Sep. 15, 2020

(54) CYLINDER BORE WALL THERMAL INSULATOR, INTERNAL COMBUSTION ENGINE, AND AUTOMOBILE

(71) Applicant: NICHIAS CORPORATION, Tokyo (JP)

(72) Inventor: Akihiro Yoshimura, Hamamatsu (JP)

(73) Assignee: NICHIAS CORPORATION, Tokyo (JP)

( * ) Notice: Subject to any disclaimer, the term of this patent is extended or adjusted under 35 U.S.C. 154(b) by 85 days.

(21) Appl. No.: 15/775,464

(22) PCT Filed: Nov. 10, 2016

(86) PCT No.: PCT/JP2016/083370

§ 371 (c)(1),
(2) Date: May 11, 2018

(87) PCT Pub. No.: WO2017/082347

PCT Pub. Date: May 18, 2017

(65) Prior Publication Data

US 2018/0363587 A1 Dec. 20, 2018

(30) Foreign Application Priority Data

Nov. 12, 2015 (JP) ..... 2015-221931

(51) Int. Cl.
*F02F 1/14* (2006.01)
*F01P 3/02* (2006.01)

(52) U.S. Cl.
CPC *F02F 1/14* (2013.01); *F01P 3/02* (2013.01); *F01P 2003/021* (2013.01)

(58) Field of Classification Search
CPC ..... F01P 2003/021; F01P 3/02; F02F 1/14; F02F 1/02; F02F 1/10; F02F 1/166
See application file for complete search history.

(56) References Cited

U.S. PATENT DOCUMENTS 8,091,518 B2 * 1/2012 Shikida ..... F02F 1/14 123/41.74
9,777,615 B2 * 10/2017 Matsumoto ..... F02F 1/14
(Continued)

FOREIGN PATENT DOCUMENTS

JP 2004-143262 A 5/2004
JP 2005-30297 A 2/2005
(Continued)

OTHER PUBLICATIONS

International Search Report dated Dec. 27, 2016, issued in counterpart application No. PCT/JP2016/083370, w/English translation. (5 pages).

(Continued)

*Primary Examiner* — Lindsay M Low
*Assistant Examiner* — Ruben Picon-Feliciano
(74) *Attorney, Agent, or Firm* — Westerman, Hattori, Daniels & Adrian, LLP

(57) ABSTRACT

A cylinder bore wall thermal it includes bore wall insulating sections provided for each of bore walls of cylinder bores and for insulating a wall surface on the cylinder bore side of the groove-like cooling water channel and a supporting section to which the bore wall insulating sections are framed. The bore wall insulating, sections include rubber members for covering the wall surface on the cylinder bore side of the groove-like cooling water channel, rear surface pressing members provided on rear surface sides of the rubber members and for pressing the entire rubber members toward the wall surface on the cylinder bore side of the groove-like cooling water channel from the rear side, and elastic members that urge the rear surface pressing members to press the rubber members toward the wall surface on the cylinder bore side of the groove-like cooling water channel.

7 Claims, 19 Drawing Sheets

(56) References Cited

U.S. PATENT DOCUMENTS

| | | | | |
|---|---|---|---|---|
| 2012/0132157 | A1* | 5/2012 | Matsuki | F02F 1/14<br>123/41.79 |
| 2015/0159540 | A1* | 6/2015 | Misumi | F02F 1/16<br>123/41.44 |
| 2015/0345363 | A1* | 12/2015 | Marutani | F02F 1/166<br>123/41.44 |
| 2017/0350302 | A1* | 12/2017 | Araki | F02F 1/14 |
| 2018/0094568 | A1* | 4/2018 | Yanagi | F02F 1/10 |

FOREIGN PATENT DOCUMENTS

| | | | |
|---|---|---|---|
| JP | 2005-256661 | A | 9/2005 |
| JP | 2007-71039 | A | 3/2007 |
| JP | 2008-31939 | A | 2/2008 |
| JP | 2015-113770 | A | 6/2015 |
| WO | 2015/156207 | A1 | 10/2015 |

OTHER PUBLICATIONS

Extended (supplementary) Search Report dated Mar. 22, 2019, issued in counterpart EP Application No. 16864308.8 (9 pages).

* cited by examiner (X-X) (Y-Y)

CYLINDER BORE WALL THERMAL INSULATOR, INTERNAL COMBUSTION ENGINE, AND AUTOMOBILE

TECHNICAL FIELD

The present invention relates to a thermal insulator disposed in contact with a wall surface on a groove-like cooling water channel of a cylinder bore wall of a cylinder block of an internal combustion engine, an internal combustion engine including the thermal insulator, and an automobile including the internal combustion engine.

BACKGROUND ART

In an internal combustion engine, the structure of which is such that an explosion of fuel occurs at a top dead point of a piston in a bore and the piston is pushed down by the explosion, temperature rises on an upper side of a cylinder bore wall and temperature falls on a lower side of the cylinder bore wall. Therefore, a difference occurs in a thermal deformation amount between the upper side and the lower side of the cylinder bore wall. Expansion is large on the upper side and, on the other hand, expansion is small on the lower side.

As a result, frictional resistance between the piston and the cylinder bore wall increases. This causes a decrease in fuel efficiency. Therefore, there is a need to reduce the difference in the thermal deformation amount between the upper side and the lower side of the cylinder bore wall.

Therefore, conventionally, in order to uniformize a wall temperature of the cylinder bore wall, it has been attempted to set a spacer in the groove-like cooling water channel for adjusting a water flow of cooling water in the groove-like cooling water channel and controlling cooling efficiency on the upper side and cooling efficiency on the lower side of the cylinder bore wall by the cooling water. For example, Patent Literature 1 discloses a heat medium channel partitioning member for internal combustion engine cooling including: a channel partitioning member disposed in a groove-like heat medium channel for cooling formed in a cylinder block of an internal combustion engine to partition the groove-like heat medium channel for cooling into a plurality of channels, the channel partitioning member being formed at height smaller than the depth of the groove-like heat medium channel for cooling and functioning as a wall section that divides the groove-like heat medium channel for cooling into a bore side channel and a counter-bore side channel; and a flexible rip member formed from the channel partitioning member toward an opening section direction of the groove-like heat medium channel for cooling and formed of a flexible material in a form with a distal end edge portion passing over one inner surface of the groove-like heat medium channel for cooling, whereby, after completion of insertion into the groove-like heat medium channel for cooling, the distal end edge portion comes into contact with the inner wall in an intermediate position in a depth direction of the groove-like heat medium channel for cooling with a deflection restoration force of the distal end edge portion to separate the bore side channel and the counter-bore side channel.

CITATION LIST

Patent Literature

[Patent Literature 1]
Japanese Patent Laid-Open No. 2008-31939 (Claims)

SUMMARY OF INVENTION

Technical Problem

With the heat medium channel partitioning member for internal combustion engine cooling of Cited Literature 1, a certain degree of uniformization of the wall temperature of the cylinder bore wall can be achieved. Therefore, it is possible to reduce the difference in the thermal deformation amount between the upper side and the lower side of the cylinder bore wall. However, in recent years, there is a need to further reduce the difference in the thermal deformation amount between the upper side and the lower side of the cylinder bore wall.

Accordingly, in recent years, uniformization of the wall temperature of the cylinder bore wall is achieved by actively insulating, with the thermal insulator, the wall surface on the cylinder bore side in the middle and lower part of the groove-like cooling water channel of the cylinder block. In order to effectively insulate the wall surface on the cylinder bore side in the middle and lower part of the groove-like cooling water channel, it is demanded that adhesion of the thermal insulator to the wall surface on the cylinder bore side in the middle and lower part of the groove-like cooling water channel is high.

Therefore, an object of the present invention is to provide a thermal insulator having high adhesion to a wall surface on a cylinder bore side of a groove-like cooling water channel.

Solution to Problem

The problem is solved by the present invention explained below. That is, the present invention (1) is a cylinder bore wall thermal insulator set in a groove-like cooling water channel of a cylinder block of an internal combustion engine including cylinder bores and for insulating bore walls in a one-side half among the bore walls of all the cylinder bores or a part of the bore walls on one side among the bore walls of all the cylinder bores, the thermal insulator including: bore wall insulating sections having an arcuate shape when viewed from above and for insulating a wall surface on the cylinder bore side of the groove-like cooling water channel; and a supporting section having a shape conforming to a shape of the groove-like cooling water channel in a setting position of the thermal insulator, the bore wall insulating sections being fixed to the supporting section, wherein the bore wall insulating sections include: rubber members in contact with the wall surface on the cylinder bore side of the groove-like cooling water channel and for covering the wall surface on the cylinder bore side of the groove-like cooling water channel; rear surface pressing members provided on rear surface sides of the rubber members and for pressing the entire rubber members toward the wall surface on the cylinder bore side of the groove-like cooling water channel from the rear side; and elastic members that urge the rear surface pressing members to press the rubber members toward the wall surface on the cylinder bore side of the groove-like cooling water channel, and only a center or a vicinity of the center in an arc direction of each of the bore wall insulating sections is fixed to the supporting section.

The present invention (2) provides the cylinder bore wall thermal insulator according to (1), wherein the rubber member is heat-sensitive expanding rubber or water-swelling rubber.

The present invention (3) provides the cylinder bore wall thermal insulator according to (1) or (2), wherein the thermal insulator includes an opening in a position opposed to a boundary between bore walls of the cylinder bores and a vicinity of the boundary.

The present invention (4) provides the cylinder bore wall thermal insulator according to any one of (1) to (3), wherein the cylinder bore wall thermal insulator is a thermal insulator for insulating the bore walls in a one-side half among the bore walls of all the cylinder bores.

The present invention (5) provides an internal combustion engine, wherein the cylinder bore wall thermal insulator according to (4) is set on both of the wall surface on one one-side half side and the wall surface on another one-side half side among all the wall surfaces on the cylinder bore side in a middle and lower part of the groove-like cooling water channel.

The present invention (6) provides an internal combustion engine, wherein the cylinder bore wall thermal insulator according to (4) is set on only the wall surface on either one one-side half side among all the wall surfaces on the cylinder bore side in a middle and lower part of the groove-like cooling water channel.

The present invention (7) provides an automobile including the internal combustion engine according to (5) or (6).

Advantageous Effects of Invention

According to the present invention, it is possible to provide a thermal insulator having high adhesion to a wall surface on a cylinder bore side of a groove-like cooling water channel. Therefore, according to the present invention, uniformity of a wall temperature of a cylinder bore wall is improved. It is possible to reduce a difference in a thermal deformation amount between an upper side and a lower side.

BRIEF DESCRIPTION OF DRAWINGS

FIG. 14 is a view

FIG. 15 is a view

FIG. 23 is a schematic perspective view

DESCRIPTION OF EMBODIMENTS

Figure 1:
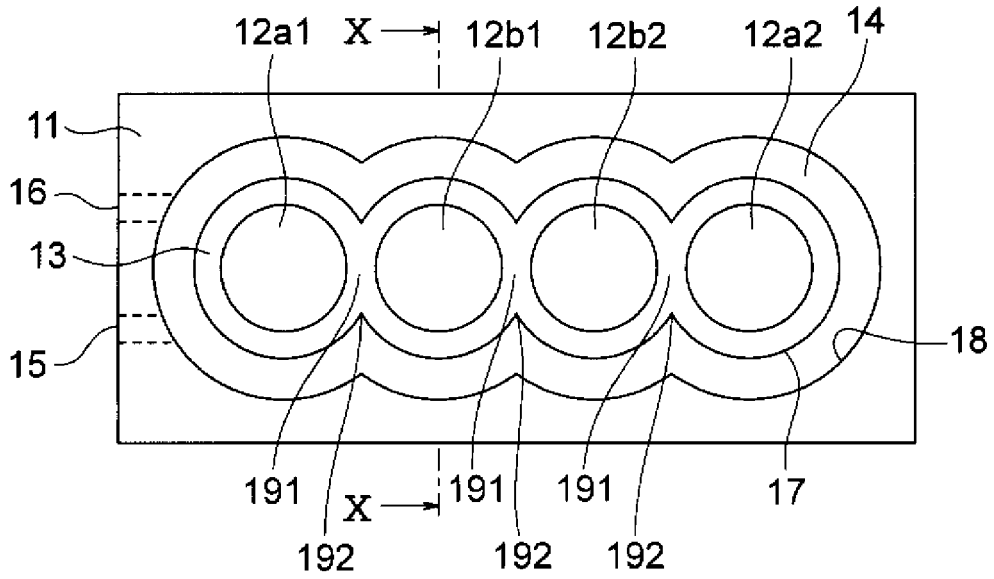
FIG. 1 is a schematic plan view showing a form example of a cylinder block in which a cylinder bore wall thermal insulator of the present invention is set.
Figure 2:
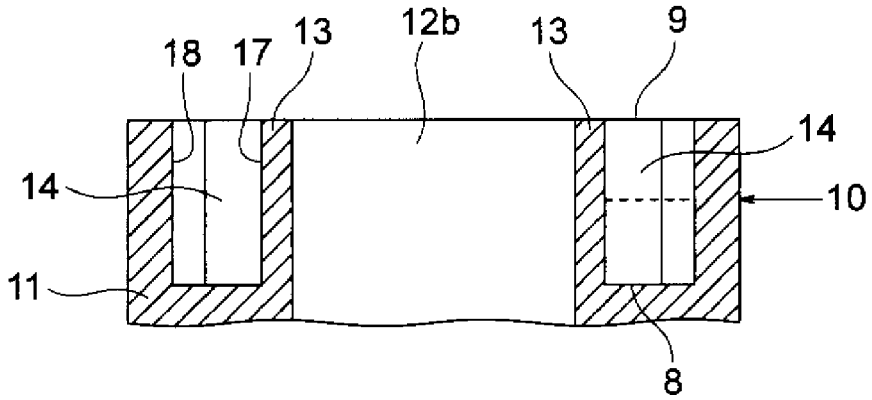
FIG. 2 is an x-x line sectional view of FIG. 1.
Figure 3:
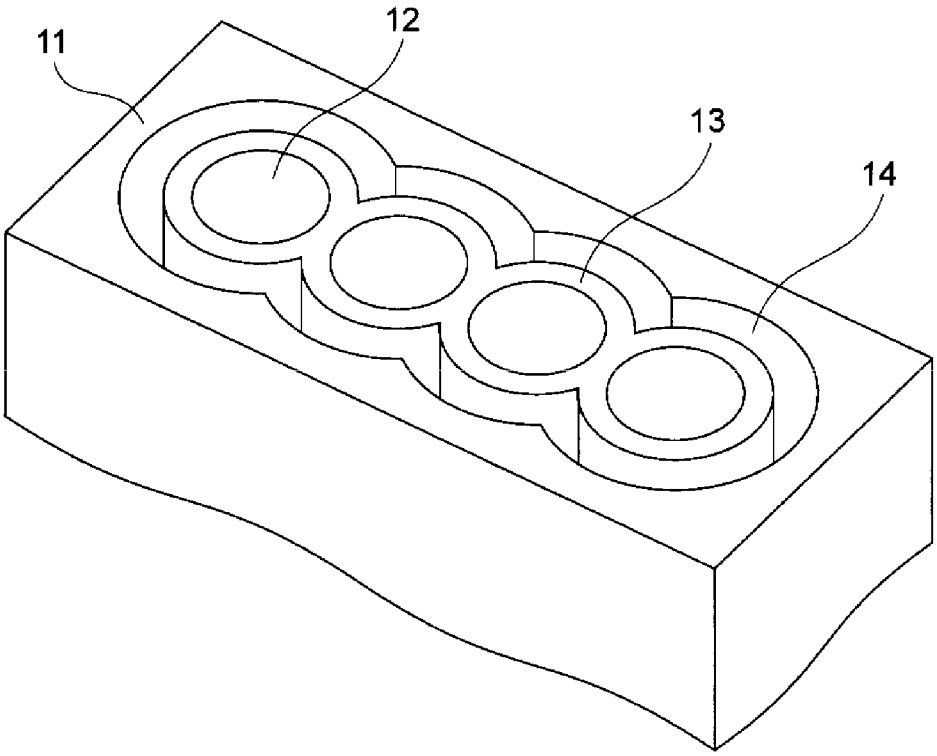
FIG. 3 is a perspective view of the cylinder block shown in FIG. 1.
Figure 4:
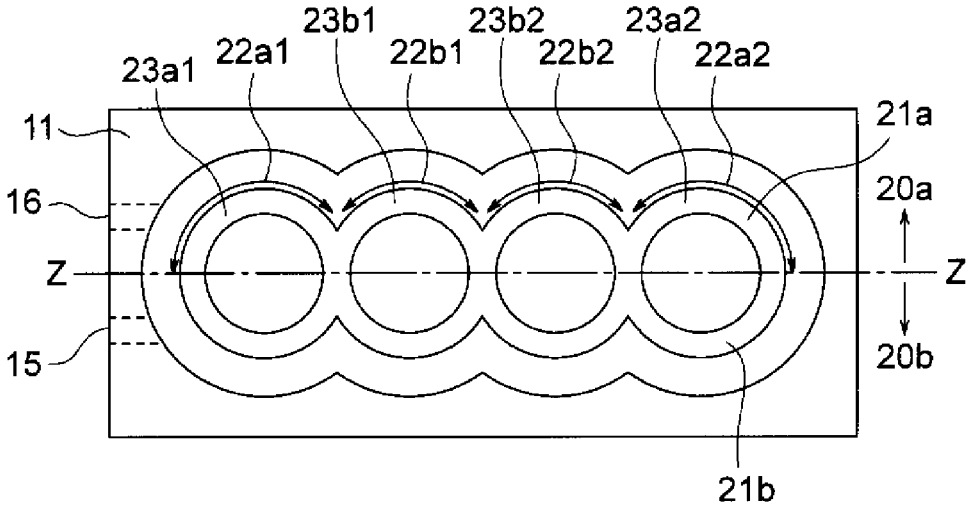
FIG. 4 is a schematic plan view showing a form example of the cylinder block in which the cylinder bore wall thermal insulator of the present invention is set.
Figure 5:
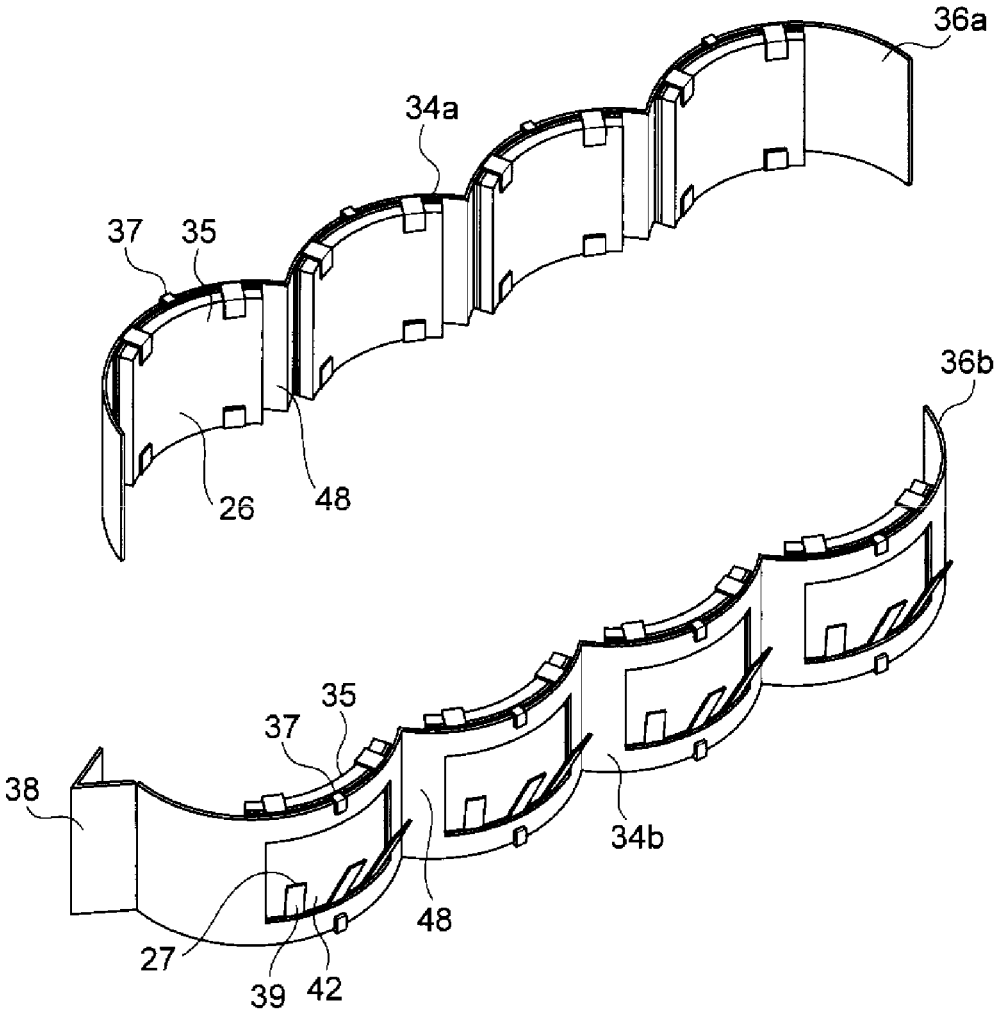
FIG. 5 is a schematic perspective view showing a form example of the cylinder bore wall thermal insulator of the present invention.
Figure 6:
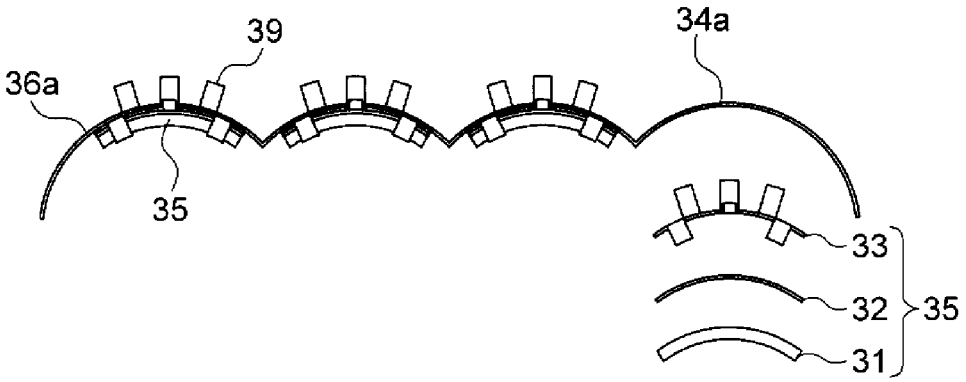
FIG. 6 is a plan view of the cylinder bore wall thermal insulator 36*a* shown in FIG. 5 viewed from an upper side.
Figure 7:
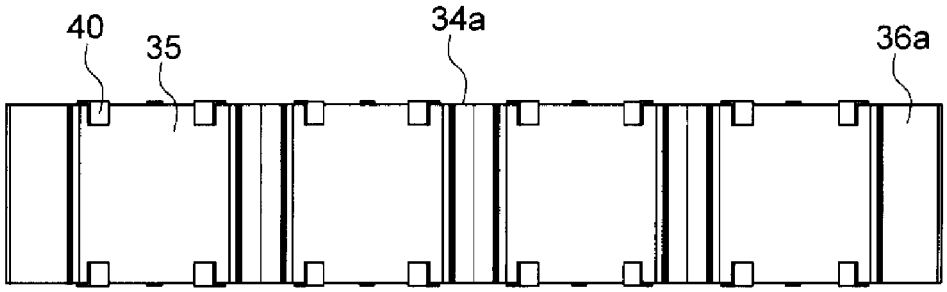
FIG. 7 is a side view of the cylinder bore wall thermal insulator 36*a* shown in FIG. 0.5 viewed from a rubber member side.
Figure 8:
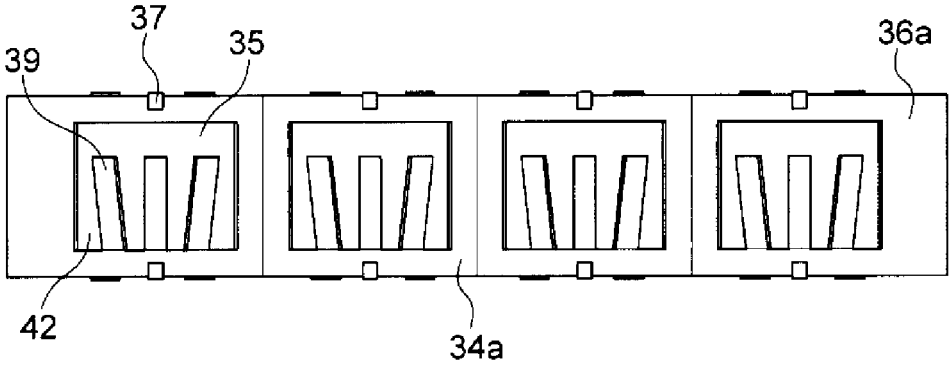
FIG. 8 is a side view of the cylinder bore wall thermal insulator 36*a* shown in FIG. 5 viewed from a rear surface side.
Figure 9:
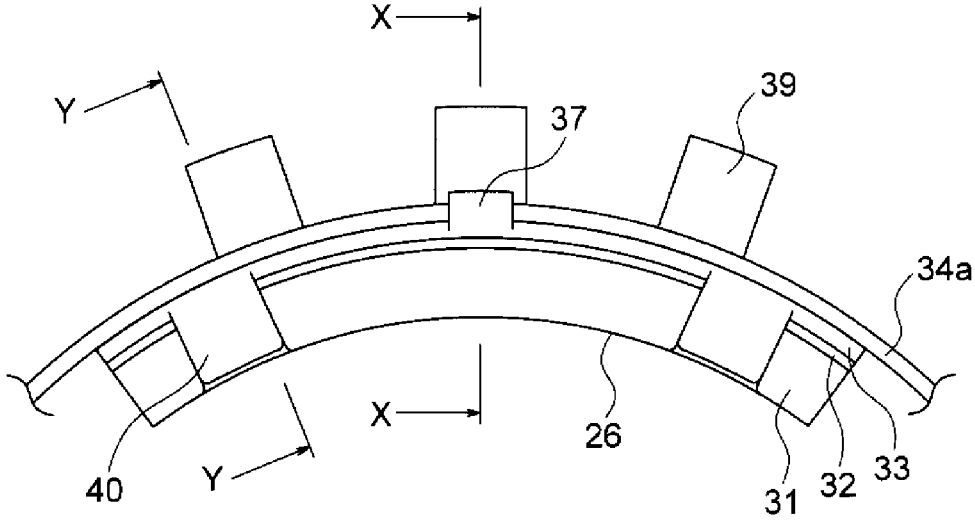
FIG. 9 is an enlarged view of the cylinder bore wall then al insulator 36*a* shown in FIG. 5.
Figure 10:
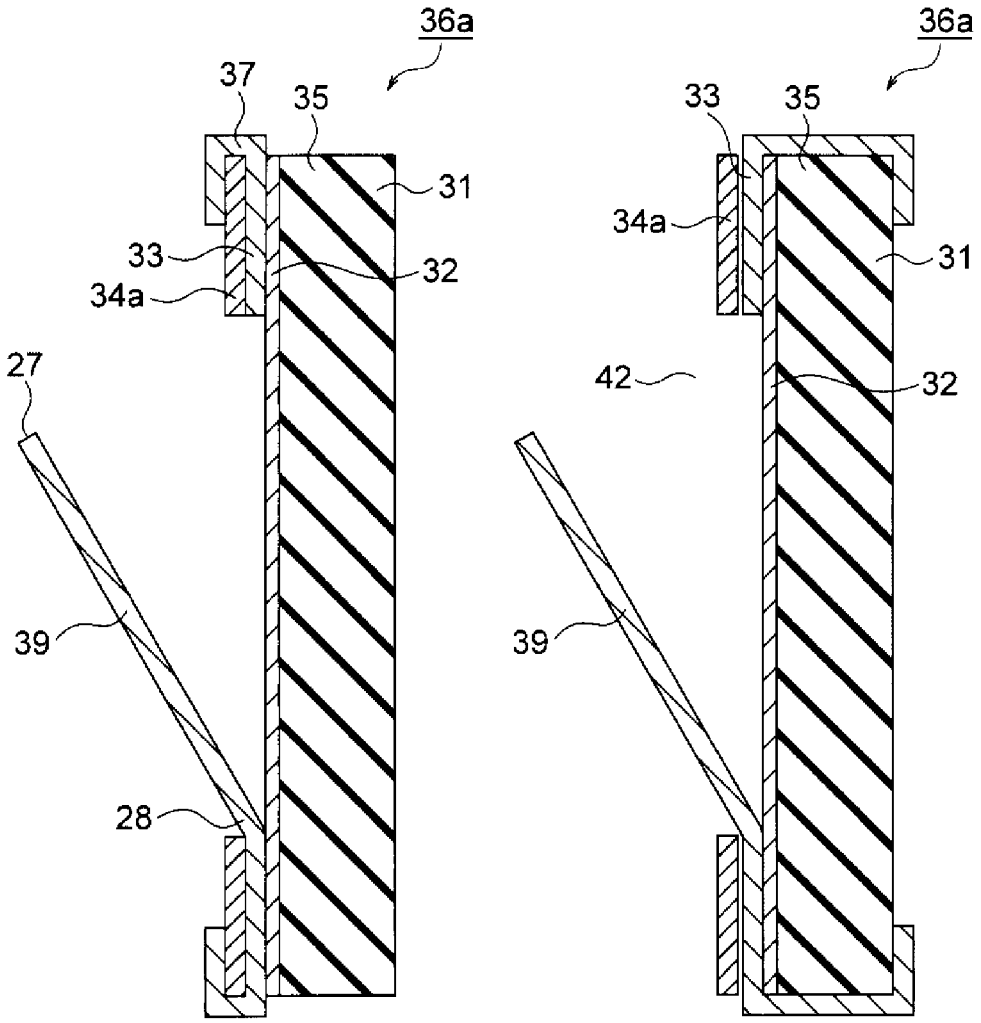
FIG. 10 is an end face view of FIG. 9.
Figure 11:
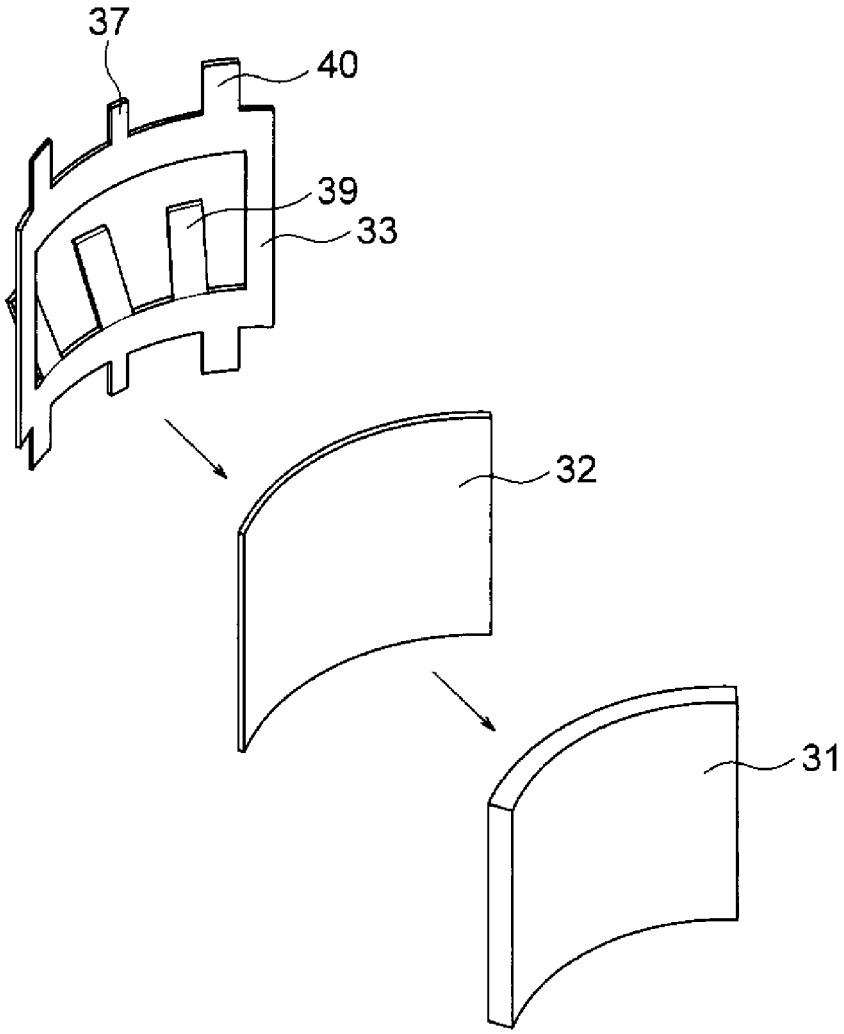
FIG. 11 is a view showing a state in which a bore wall insulating section 35 in FIG. 5 are manufactured.
Figure 12:
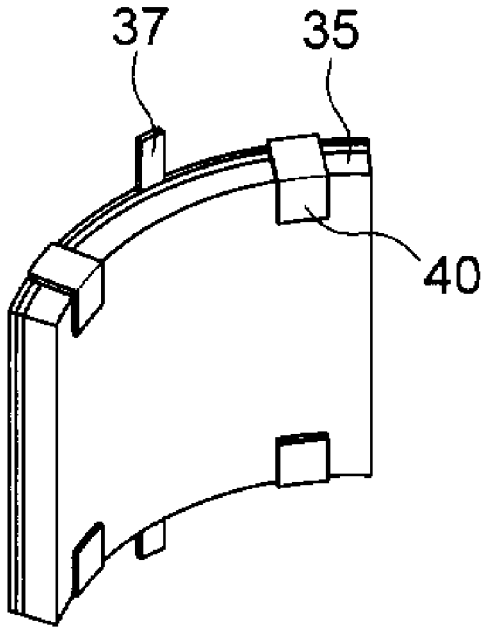
FIG. 12 is a perspective view showing the bore wall insulating section 35 before being fixed to a supporting section 34*a*.
Figure 13:
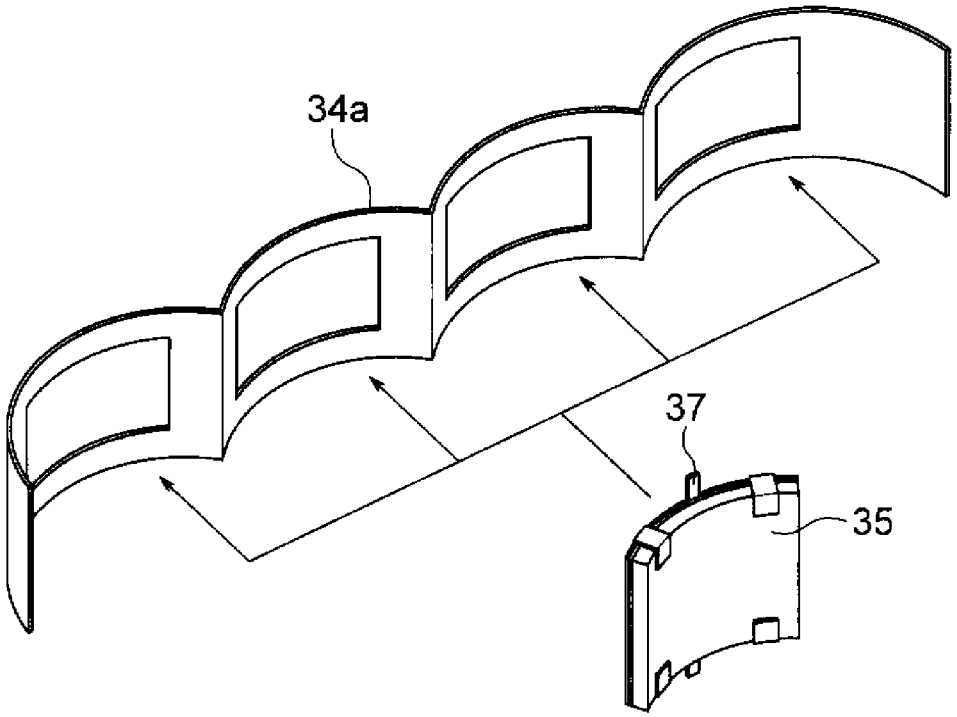
FIG. 13 is a view showing a state in which the bore wall insulating section 35 is fixed to the supporting section 34*a*.
Figure 14A:
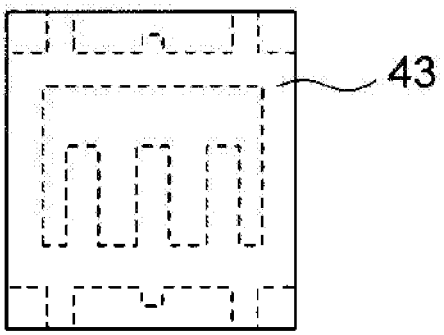
FIGS. 14(A) and 14(B) are views showing a state in which a metal-spring attaching member 33 is manufactured.
Figure 14B:
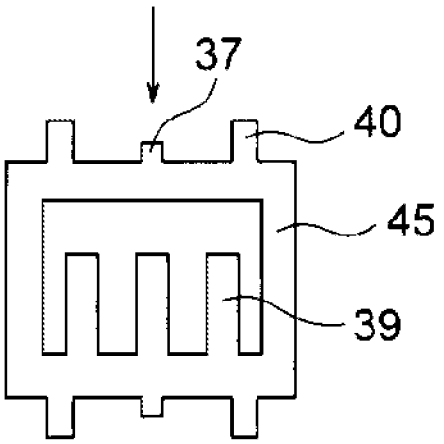
Figure 15A:
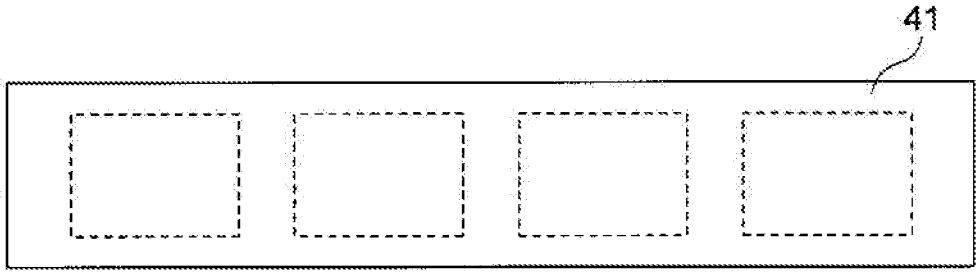
FIGS. 15(A) and 15(B) are views showing a state in which the supporting section 34*a* is manufactured.
Figure 15B:
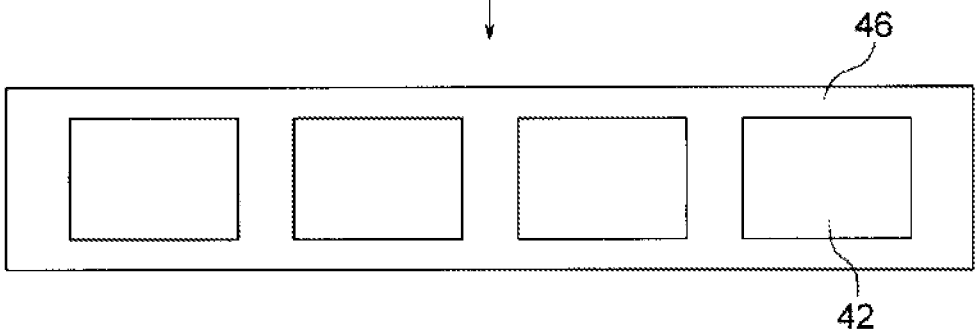

A cylinder bore wall thermal insulator of the present invention and an internal combustion engine of the present invention are explained with reference to FIG. 1 to FIG. 15(B). FIG. 1 to FIG. 4 show a form example of a cylinder block in which the cylinder bore wall thermal insulator of the present invention is set. FIG. 1 and FIG. 4 are a schematic plan view showing the cylinder block in which the cylinder bore wall thermal insulator of the present invention is set. FIG. 2 is an x-x line sectional view of FIG. 1. FIG. 3 is a perspective view of the cylinder block shown in FIG. 1. FIG. 5 is a schematic perspective view showing a form example of the cylinder bore wall thermal insulator of the present invention. FIG. 6 is, a view of a thermal insulator 36*a* shown in FIG. 5 viewed from above. Note that, in FIG. 6, a thermal insulator at the right end among the bore wall insulating sections 35 fixed to the thermal insulator 36*a* is shown as being separated into each of the components. FIG. 7 is a view of the thermal insulator 36*a* shown in FIG. 5 viewed from a side and a view of the thermal insulator 36*a* viewed from a contact surface side of the rubber member 31. FIG. 8 is a view of the thermal insulator 36*a* in FIG. 5 viewed from a side and a view of the thermal insulator 36*a* viewed from the rear surface side. FIG. 9 is an enlarged view of one of the bore wall insulating sections 35 fixed to a supporting section 34*a* in FIG. 5 and a view of the bore wall insulating sections 35 and the supporting section 34*a* viewed from above. FIG. 10 is an end face view of an X-X line and a Y-Y line in FIG. 9. FIG. 11 is a view showing a state in which the bore wall insulating section 35 in FIG. 5 is manufactured. FIG. 12 is a perspective view showing the bore wall insulating section 35 before being fixed to the supporting section 34*a*. FIG. 13 is a view showing a state in which the bore wall insulating section 35 is fixed to the supporting section 34*a*. FIGS. 14(A) and 14(B) are views showing a state in which a metal-spring attaching member 33 is manufactured. FIGS. 15(A) and 15(B) are views showing a state in which the supporting section 34*a* is manufactured.

As shown in FIG. 1 to FIG. 3, in a cylinder block 11 of an open deck type of an internal combustion engine for vehicle mounting in which the cylinder bore wall thermal insulator is set, a bore 12 for a piston to move up and down and a groove-like cooling water channel 14 for feeding cooling water are formed. A wall partitioning the bore 12 and the groove-like cooling water channel 14 is a cylinder bore wall 13. In the cylinder block 11, a cooling water supply port 15 for supplying the cooling water to the groove-like cooling water channel 11 and a cooling water discharge port 16 for discharging the cooling water from the groove-like cooling water channel 11 are formed.

In the cylinder block 11, two or more bores 12 are formed side by side in series. Therefore, as the bores 12, there are end bores 12*a*1 and 12*a*2 adjacent to one bore and intermediate bores 12*b*1 and 12*b*2 sandwiched by two bores (note that, when the number of bores of the cylinder block is two, there are only the end bores). Among bores formed side by side in series, the end bores 12*a*1 and 12*a*2 are bores at both ends. The intermediate bores 12*b*1 and 12*b*2 are bores present between the end bore 12*a*1 at one end and the end bore 12*a*2 at the other end. A wall between the end bore 12*a*1 and the intermediate bore 12*b*1, a wall between the intermediate bore 12*b*1 and the intermediate bore 12*b*2, and a wall between the intermediate bore 12*b*2 and the end bore 12*a*2 (inter-bore walls 191) are portion sandwiched by two bores. Therefore, since heat is transmitted from two cylinder bores, wall temperature is higher than other walls. Therefore, on a wall surface 17 on the cylinder bore side of the groove-like cooling water channel 14, temperature is the highest near the inter-bore walls 191. Therefore, the temperature of a boundary 192 of the bore walls of the cylinder bores and the vicinity of the boundary 192 is the highest in the wall surface 17 on the cylinder bore side of the groove-like cooling water channel 14.

In the present invention, in a wall surface of the groove-like cooling water channel 14, a wall surface on the cylinder bore 13 side is described as wall surface 17 on the cylinder bore side of the groove-like cooling water channel. In the wall surface of the groove-like cooling water channel 14, a wall surface on the opposite side of the wall surface 17 on the cylinder bore side of the groove-like cooling water channel is described as wall surface 18.

In the present invention, a one-side half indicates a half on one side at the time when the cylinder block is vertically divided into two in a direction in which the cylinder bores are disposed side by side. Therefore, in the present invention, bore walls on the one-side half among the bore walls of all the cylinder bores indicate bore walls in the half on the one side at the time when all the cylinder bore walls are vertically divided into two in the direction in which the cylinder bores are disposed side by side. For example, in FIG. 4, the direction in which the cylinder bores are disposed side by side is a Z-Z direction. Each of bore walls in one-side halves at the time when the cylinder bore wall is divided into two by this Z-Z line is a bore wall in a one-side half among the bore walls of all the cylinder bores. That is, in FIG. 4, the bore wall in a one-side half further on the 20*a* side than the Z-Z line is a bore wall 21*a* in one one-side half among the bore walls of all the cylinder bores. The bore wall in a one-side half further on the 20*b* side than the Z-Z line is a bore wall 21*b* in the other one-side half among the bore walls of all the cylinder bores. One side among all the cylinder bore walls indicates either the bore wall 21*a* in the one-side half or the bore wall 21*b* in the one-side half. A part of one side indicates a part of the bore wall 21*a* in the one-side half or a part of the bore wall 21*b* in the one-side half.

In the present invention, the bore walls of the cylinder bores indicate bore wall portions corresponding to individual cylinder bores. In FIG. 4, a range indicated by a double-headed arrow 22*a*1 is a bore wall 23*a*1 of the cylinder bore 12*a*1, a range indicated by a double-headed arrow 22*b*1 is a bore wall 23*b*1 of the cylinder bore 12*b*1, a range indicated by a double-headed arrow 22*b*2 is a bore wall 23*b*2 of the cylinder bore 12*b*2, and a range indicated by a double-headed arrow 22*a*2 is a bore wall 23*a*2 of the cylinder bore 12*a*2. That is, the bore wall 23*a*1 of the cylinder bore 12*a*1, the bore wall 23*b*1 of the cylinder bore 12*b*1, the bore wall 23*b*2 of the cylinder bore 12*b*2, the bore wall 23*a*2 of the cylinder bore 12*a*2 are respectively the bore walls of the cylinder bores.

The cylinder bore wall thermal insulator 36*a* shown in FIG. 5 is a thermal insulator for insulating the bore wall 21*a* in one one-side half (on the 20*a* side) in FIG. 4. The cylinder bore wall thermal insulator 36*b* is a thermal insulator for insulating the bore wall 21*b* in the other one-side half (on the 20*b* side) in FIG. 4. The cylinder bore wall thermal insulator 36*a* and the cylinder bore wall thermal insulator 36*b* are different in that, whereas a cooling-water-flow partitioning member 38 is not attached to the cylinder bore wall thermal insulator 36*a*, the cooling-water-flow partitioning member 38 is attached to the cylinder bore wall thermal insulator 36*b*. Otherwise, the cylinder bore wall thermal insulator 36*a* and the cylinder bore wall thermal insulator 36*b* are the same. The cooling-water-flow partitioning member 38 is a member for partitioning the cooling water supply port 15 and the cooling water discharge port 16 such that, in the cylinder block 11 shown in FIG. 4, the cooling water supplied from the cooling water supply port 15 to the groove-like cooling water channel 14 flows toward an end on the opposite side of the position of the cooling water supply port 15 in the groove-like cooling water channel 14 in the other one-side half on the 20*b* side first without being immediately discharged from the cooling water discharge port 16 present in the vicinity and, when reaching the end on the opposite side of the position of the cooling water supply port 15 of the groove-like cooling water channel 14 in the one-side half on the 20*b* side, turns to the groove-like cooling water channel 14 in the one-side half on the 20*a* side, subsequently, flows toward the cooling water discharge port 16 in the groove-like cooling water channel 14 in the one-side half on the 20*a* side, and is finally discharged from the cooling water discharge port 16. In FIG. 4, a cylinder block of a form is shown in which the cooling water flowing to the end in the groove-like cooling water channel 14 in the one-side half on the 20*a* side is discharged from the cooling water discharge port 16 formed on the lateral side of the cylinder block 11. Besides, for example, there is a cylinder block of a form in which the cooling water flowing from one end to the other end in the groove-like cooling water channel 14 in the one-side half on the 20*a* side flows into a cooling water channel formed in the cylinder head rather than being discharged from the lateral side of the cylinder block.

The cylinder bore wall thermal insulator 36*a* includes four bore wall insulating sections 35 and the supporting section 34*a* to which the bore wall insulating sections 35 are fixed. That is, in the cylinder bore wall thermal insulator 36*a*, one bore wall insulating section 35 are fixed to each of four places of the supporting section 34*a*. Similarly, the cylinder bore wall thermal insulator 36*b* includes four bore wall insulating sections 35 and the supporting section 34*b* to which the bore wall insulating sections 35 are fixed. In the cylinder bore wall thermal insulator 36*a* and the cylinder bore wall thermal insulator 36*b*, the bending sections 37 of the insulating sections 35 are bent and the bending sections 37 hold the upper and lower end portions of the supporting section 34*a* or the supporting section 34*b*, whereby the bore wall insulating sections 35 are fixed to the supporting section 34*a* or the supporting section 34*b*.

As shown in FIG. 5 to FIG. 8, the cylinder bore wall thermal insulator 36*a* is a thermal insulator for insulating the bore wall 21*a* in the one-side half of the cylinder block 11 shown in FIG. 4. In the bore wall 21*a* in the one-side half of the cylinder block 11, there are four bore walls of the cylinder bores, that is, the bore wall 23*a*1 of the cylinder bore 12*a*1, the bore wall 23*b*1 of the cylinder bore 12*b*1, the bore wall 23*b*2 of the cylinder bore 12*b*2, and the bore wall 23*a*2 of the cylinder bore 12*a*2. In the cylinder bore wall thermal insulator 36*a*, the bore wall insulating sections 35 are provided for each of the cylinder bore walls. Therefore, the four bore wall insulating sections 35 are provided in the cylinder bore wall thermal insulator 36*a*.

In the cylinder bore wall thermal insulator 36*a*, the bore wall insulating sections 35 are fixed such that a contact surface 26 of the rubber member 31 faces the cylinder bore wall side and the contact surface 26 of the rubber member 31 can come into contact with the wall surface 17 on the cylinder bore side of the groove-like cooling water channel 14. On the rear surface side of the cylinder bore wall insulating section 36*a*, metal leaf springs 39 attached to the bore wall insulating sections 35 project toward the opposite side of the rubber member 31 through openings 42 of the supporting section 34. Projecting distal ends 27 of the metal leaf springs 39 are in contact with the wall surface 18 on the opposite side of the wall surface 17 on the cylinder bore side of the groove-like cooling water channel 14.

The bore wall insulating section 35 fixed to the cylinder bore wall insulating section 36*a* includes, as shown in FIG. 6, FIG. 9, and FIG. 10, the rubber member 31, a rear surface pressing member 32, and the metal-leaf-spring attaching member 33.

The rubber member 31 is molded into an arcuate shape when viewed from above. The shape on the contact surface 26 side of the rubber member 31 is a shape conforming to the wall surface on the cylinder bore side of the groove-like cooling water channel 14. The rubber member 31 is a member in direct contact with the bore wall 22 of the cylinder bore to cover a insulating part of the bore wall 22 and insulate the bore wall 22 of the cylinder bore. The rear surface pressing member 32 is molded into an arcuate shape when viewed from above. The rear surface pressing member 32 has a shape conforming to the rear surface side (a surface on the opposite side of the contact surface 26 side) of the rubber member 31 such that the rear surface pressing member 32 can press the entire rubber member 31 from the rear surface side of the rubber member 31. The metal-leaf-spring biasing member 33 is molded into an arcuate shape when viewed from above. The metal-leaf-spring attaching member 33 has a shape conforming to the rear surface side (a surface on the opposite side of the rubber member 31) of the rear surface pressing member 32. The metal leaf springs 39, which are elastic members, are attached to the metal-leaf-spring attaching member 33. The metal leaf springs 39 are vertically long rectangular metal plates. One ends in the longitudinal direction are connected to the metal-leaf-spring attaching member 33. The metal leaf springs 39 are attached to the metal-leaf-spring attaching member 33 by being bent from the metal-leaf-spring attaching member 33 on the other end side 28 connected to the metal-leaf-spring attaching member 33 such that the distal ends 27 separate from the metal-leaf-spring attaching member 33. The bending sections 40 formed on the upper side and the lower side of the metal-leaf-spring attaching member 33 are bent and sandwiched between the metal-leaf-spring attaching member 33 and the bending sections 40, whereby the rubber member 31 and the rear surface pressing member 32 are fixed to the metal-leaf-spring attaching member 33. In the rubber member 31, a surface of the rubber member 31 on the opposite side of the rear surface pressing member 32 side are the contact surface 26 in contact with the wall surface 17 on the cylinder bore side of the groove-like cooling water channel.

The bore wall insulating section 35 is a member for insulating the bore wall of the cylinder bore. When the cylinder bore wall thermal insulator 36*a* is set in the groove-like cooling water channel 14 of the cylinder block 11, the rubber member 31 comes into contact with the wall surface 17 on the cylinder bore side of the groove-like cooling water channel 14, the wall surface 17 on the cylinder bore side of the groove-like cooling water channel 14 is covered with the rubber member 31, and the rear surface pressing member 32 presses the rubber member 31 from the rear surface side toward the wall surface 17 on the cylinder bore side of the groove-like cooling water channel 14 with an urging force of the metal leaf springs 39, which are the elastic members, to cause the rubber member 31 to adhere to the wall surface 17 on the cylinder bore side of the groove-like cooling water channel 14, whereby the bore wall insulating section 35 insulates the bore wall of the cylinder bore.

The supporting section 34*a* is formed in a shape of continuous four arcs when viewed from above. The shape of the supporting section 34*a* is a shape conforming to a one-side half of the groove-like cooling water channel 14. In the supporting section 34*a*, the opening 42 is formed such that the metal leaf springs 39 attached to the bore wall insulating sections 35 can pass through the supporting section 34*a* from the rear surface side of the cylinder bore wall thermal insulator 36*a* and project toward the wall surface 18 on the opposite side of the wall surface 17 on the cylinder bore side of the groove-like cooling water channel 14.

The supporting section 34*a* is a member to which the bore wall insulating section 35 is fixed. The supporting section 34*a* plays a role of deciding a position of the bore wall insulating section 35 such that the position of the bore wall insulating section 35 does not deviate in the groove-like cooling water channel 14. The supporting section 34*a* is formed of a continuous metal plate from one end side to the other end side when viewed from above.

In the cylinder bore wall thermal insulator 36*a*, only the center or the vicinity of the center in the arc direction viewed from above (the center or the vicinity of the center of the arcuate bore wall insulating section at the time when the bore wall insulating section is viewed from above) of the bore wall insulating section 35 is fixed to the supporting section 34*a*. The X-X end face view of FIG. 10 is an end face view cut in the center of the bore wall insulating section 35. In the X-X end face view, each of the upper end and the lower end of the metal-leaf-spring attaching member 33 is fixed to the supporting section 34*a* by the bending section 37. On the other hand, the Y-Y end face view of FIG. 10 is an end face view cut in a portion at the end of the bore wall insulating section 35. In the Y-Y end face view, the metal-leaf-spring attaching member 33 is not fixed to the supporting section 34*a*.

A manufacturing procedure of the cylinder bore wall thermal insulator 36*a* is explained. As shown in FIG. 11, the rear surface pressing member 32 and the metal-leaf-spring attaching member 33, in which the metal leaf springs 39 are attached and the bending sections 40 and the bending sections 37 are formed, are joined to the rubber member 31 from the rear surface side of the rubber member 31 in order. Subsequently, the bending sections 40 are bent to hold the rear surface pressing member 32 and the rubber member 31 with the bending sections 40 as shown in FIG. 12, whereby the rear surface pressing member 32 and the rubber member 31 are fixed to the metal-leaf-spring attaching member 33 to manufacture the bore wall insulating section 35. As shown in FIG. 13, four bore wall insulating sections 35 are manufactured. The bending sections 37 are bent in fixing parts of the supporting section 34*a* and the supporting section 34*a* is held by the bending sections 37, whereby the bore wall insulating section 35 is fixed to the supporting section 34*a* to manufacture the cylinder bore wall thermal insulator 36*a*.

Figure 16:
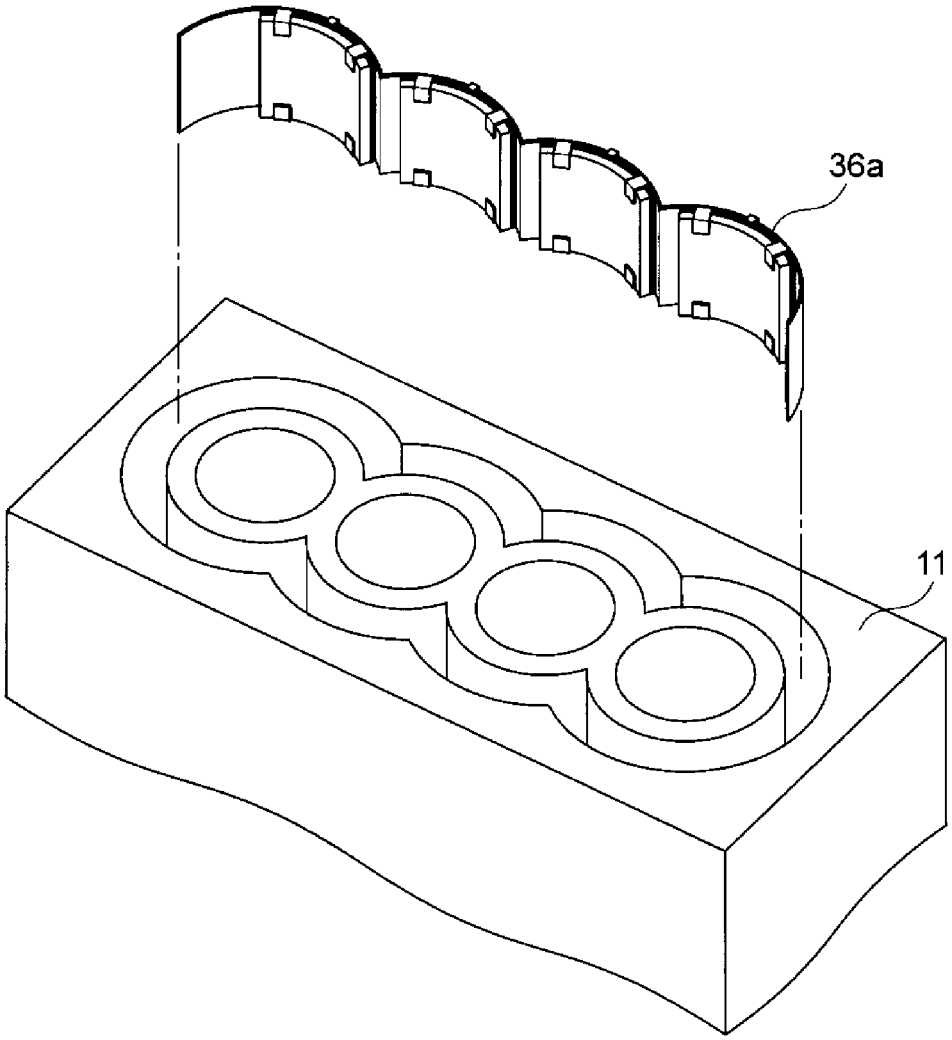
FIG. 16 is a schematic view showing a state in which a cylinder bore wall thermal insulator 36*a* is set in a cylinder block 11 shown in FIG. 1.
Figure 17:
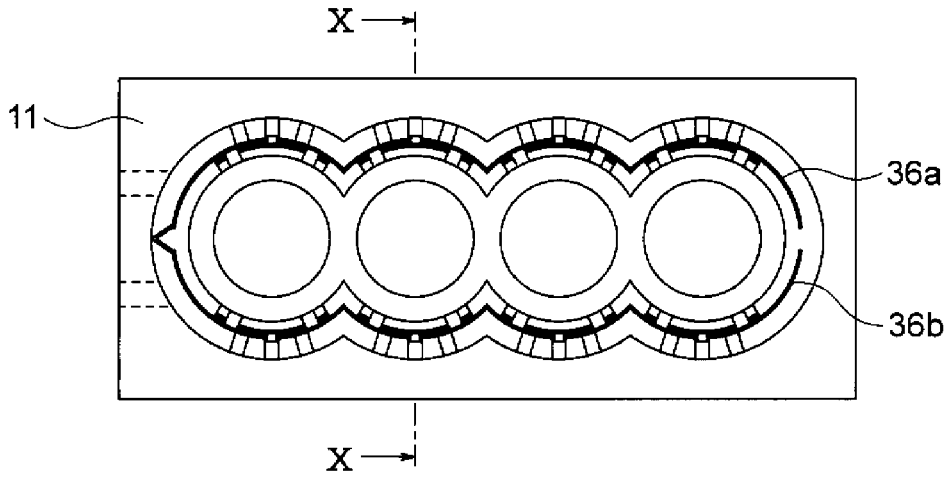
FIG. 17 is a schematic view showing a state in which two cylinder bore wall thermal insulators 36*a* and 36*b* are set in the cylinder, block 11 shown in FIG. 1.
Figure 18:
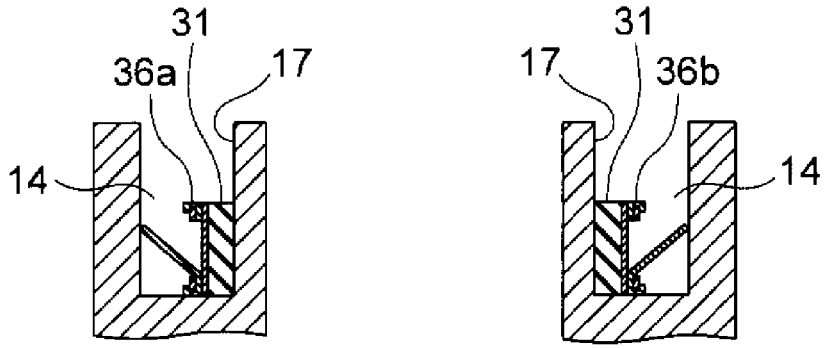
FIG. 18 is a schematic view showing a state in which two cylinder bore wall thermal insulators 36*a* and 36*b* are set in the cylinder block 11 shown in FIG. 1.

Note that, as a manufacturing procedure of the metal-leaf-spring attaching member 33, as shown in FIGS. 14(A) and 14(B), a metal plate 43 is prepared and the metal plate 43 is punched in positions of dotted lines in FIG. 14(A), whereby, as shown in FIG. 14(B), the metal leaf springs 39, the bending sections 40, and the bending sections 37 are formed to manufacture a punched product 45 of the metal plate. Subsequently, the entire punched product 45 of the metal plate is molded into an arcuate shape and the metal leaf springs 39 are bent to the rear surface side, whereby the metal-leaf-spring attaching member 33 is manufactured. As a manufacturing procedure of the supporting section 34*a*, as shown in FIGS. 15(A) and 15(B), a metal plate 41 is prepared and the metal plate 41 is punched in positions of dotted lines in FIG. 15(A), whereby, as shown in FIG. 15(B), the openings 42 are formed to manufacture a punched product 46 of the metal plate. Subsequently, the entire punched product 46 of the metal plate is molded into a shape of four continuous arcs, whereby the supporting section 34*a* is manufactured, The cylinder bore wall thermal insulator 36*a* is set in, for example, the groove-like cooling water channel 14 of the cylinder block 11 shown in FIG. 1. As shown in FIG. 16, the cylinder bore wall thermal insulator 36*a* is inserted into the groove-like cooling water channel 14 of the cylinder block 11. As shown in FIG. 17 and FIG. 18, the cylinder bore wall thermal insulator 36*a* is set in the groove-like cooling water channel 14. Although not shown in FIG. 16, similarly, the cylinder bore wall thermal insulator 36*b* is inserted into the groove-like cooling water channel 14 of the cylinder block 11. As shown in FIG. 17 and FIG. 18, the cylinder bore wall thermal insulator 36*b* is set in the groove-like cooling water channel 14. In this way, the cylinder bore wall thermal insulator 36*a* is set on the wall surface 17*a* side in a one-side half and the cylinder bore wall thermal insulator 36*b* is set on the wall surface 17*b* side in another one-side half.

At this time, in the cylinder bore wall thermal insulator 36*a*, the metal leaf springs 39 are attached such that the distance from the contact surface 26 of rubber member 31 of the bore wall insulating section 35 to the distal end sides 27 of the metal leaf springs 39 is larger than the width of the groove-like cooling water channel 14. Therefore, when the cylinder bore wall thermal insulator 36*a* is set in the groove-like cooling water channel 14, the metal leaf springs 39 are sandwiched between the rear surface of the bore wall insulating section 35 and the wall surface 18, whereby a force is applied to the distal ends 27 of the metal leaf springs 39 in a direction toward the metal-leaf-spring attaching member 33. Consequently, the metal leaf springs 39 are deformed such that the distal ends 27 approach the metal-leaf-spring attaching member 33 side. Therefore, a restoring elastic force is generated in the metal leaf springs 39. The metal-leaf-spring attaching member 33 is pushed toward the wall surface 17 on the cylinder bore side of the groove-like cooling water channel with the elastic force. As a result, the rubber member 31 is pressed against the wall surface 17 on the cylinder bore side of the groove-like cooling water channel by the rear surface pressing member 32 pushed by the metal-leaf-spring attaching member 33. That is, the cylinder bore wall thermal insulator 36*a* is set in the groove-like cooling water channel 14, whereby the metal leaf springs 39 are deformed. The rear surface pressing member 32 is urged by a restoring force of the deformation to press the rubber member 31 against the wall surface 17 on the cylinder bore side of the groove-like cooling water channel. In this way, the rubber member 31 of the bore wall insulating section 35 of the cylinder bore wall thermal insulator 36*a* comes into contact with the bore wall surfaces of the cylinder bores of the wall surface 17*a* in one one-side half of the entire wall surface 17 on the cylinder bore side of the groove-like cooling water channel. The rubber member 31 of the bore wall insulating section 35 of the cylinder bore wall thermal insulator 36*a* comes into contact with the bore walls of the cylinder bores of the wall surface 17*b* in the other one-side half of the entire wall surface 17 on the cylinder bore side of the groove-like cooling water channel.

Figure 19A:
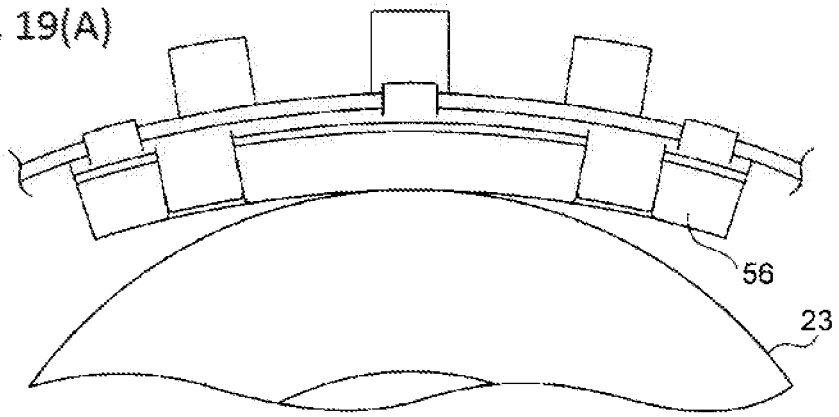
FIGS. 19(A) and 19(B) are views showing a state in which the bore wall insulating section of the cylinder bore wall thermal insulator is in contact with a bore wall.
Figure 19B:
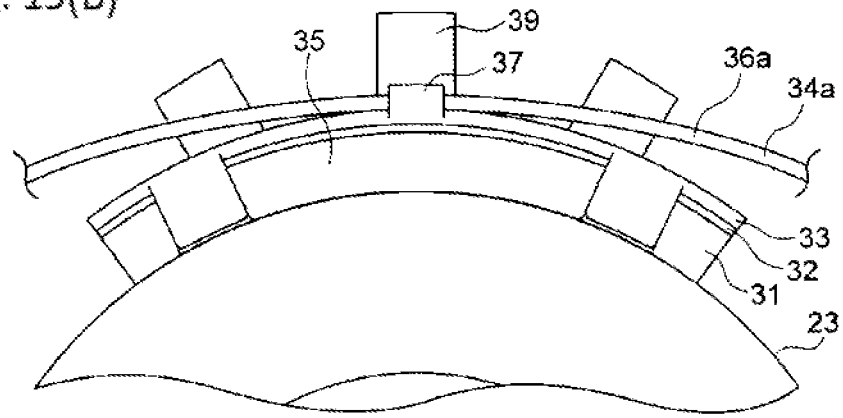

At this time, in the cylinder bore wall thermal insulator 36*a*, only the center or the vicinity of the center in the arc direction at the time when the bore wall thermal insulator is viewed from above of the bore wall insulating section 35 is fixed to the supporting section 34*a*. Therefore, when the metal-leaf-spring attaching member 33 and the rear surface pressing member 32 of the bore wall insulating section 35 are urged by the metal leaf springs 39, the metal-leaf-spring attaching member 33, the rear surface pressing member 32, and the rubber member 31 can be deformed independently from the supporting section 34*a*. This is explained with reference to FIGS. 19(A) and 19(B). In manufacturing of the cylinder bore wall thermal insulator, the rubber member is machined such that a curvature of the contact surface of the rubber member of the bore wall insulating section coincides with a curvature of the wall surface of the bore wall of the cylinder bore in contact with the rubber member. However, actually, machining errors occur with respect to design values in both of the contact surface of the rubber member and the wall surface of the bore wall of the cylinder bore. When the curvature of the contact surface of the rubber member is smaller than the curvature of the wall surface of the bore wall of the cylinder bore because of the machining error of the contact surface of the rubber member or the wall surface of the bore wall of the cylinder bore, as shown in FIG. 19(A), if the entire thermal insulator is fixed to the supporting section (e.g., if three places in total, that is, the vicinity of the center and both the ends in the are direction at the time when the thermal insulator is viewed from above are fixed to the supporting section), the vicinity of the center in the arc direction of the rubber member 56 can come into contact with the bore wall 23 of the cylinder bore when being urged by the metal leaf springs. However, portions at the ends cannot come into contact with the bore wall. On the other hand, when the curvature of the contact surface of the rubber member is smaller than the curvature of the wall surface of the bore wall of the cylinder bore, as shown in FIG. 19(B), if only the center or the vicinity of the center of the bore wall insulating section 35 in the arc direction at the time when the bore wall insulating section is viewed from above is fixed to the supporting section 34*a*, the portions at the ends of the bore wall insulating section 35 can be deformed to separate from the supporting section 34*a* to move toward the bore wall 23 of the cylinder bore when being urged by the metal leaf spring 39. Therefore, not only the vicinity of the center in the arc direction of the rubber member 31 but also the ends of the rubber member 31 can come into contact with the bore wall 23 of the cylinder bore. Therefore, in the cylinder bore wall thermal insulator 36*a*, even if there is a difference between the curvatures of the contact surface 26 of the roubber member 31 and the bore wall 23 of the cylinder bore because of the machining error, the rubber member 31 can be surely brought into contact with the wall surface of the bore wall of the cylinder bore. Therefore, adhesion of the bore wall 23 of the cylinder bore of the rubber member 31 to the wall surface (the wall surface 17 on the cylinder bore side of the groove-like cooling water channel 14) is improved.

The cylinder bore wall thermal insulator of the present invention is a cylinder bore wall thermal insulator set in a groove-like cooling water channel of a cylinder block of an internal combustion engine including cylinder bores and for insulating bore walls in a one-side half among the bore walls of all the cylinder bores or a part of the bore walls on one side among the bore walls of all the cylinder bores.

The thermal insulator includes bore wall insulating sections having an arcuate shape when viewed from above and for insulating a wall surface on the cylinder bore side of the groove-like cooling water channel and a supporting section having a shape conforming to a shape of the groove-like cooling water channel in a setting position of the thermal insulator, the bore wall insulating sections being fixed to the supporting section.

The bore wall insulating sections include rubber members in contact with the wall surface on the cylinder bore side of the groove-like cooling water channel and for covering the wall surface on the cylinder bore side of the groove-like cooling water channel, rear surface pressing members provided on rear surface sides of the rubber members and for pressing the entire rubber members toward the wall surface on the cylinder bore side of the groove-like cooling water channel from the rear side, and elastic members that urge the rear surface pressing members to press the rubber members toward the wall surface on the cylinder bore side of the groove-like cooling water channel.

Only a center or a vicinity of the center in an arc direction of the bore wall insulating section is fixed to the supporting section.

The cylinder bore wall thermal insulator of the present invention is set in the groove-like cooling water channel of the cylinder block of the internal combustion engine. The cylinder block in which the cylinder bore wall thermal insulator of the present invention is set is a cylinder block of an open deck type in which two or more cylinder bores are formed side by side in series. When the cylinder block is the cylinder block of an open deck type in which two cylinder bores are formed side by side in series, the cylinder block includes cylinder bores including two end bores. When the cylinder block is a cylinder block of an open deck type in which three or more cylinder bores are formed side by side in series, the cylinder block includes cylinder bores including two end bores and one or more intermediate bores. Note that, in the present invention, among the cylinder bores formed in series, bores at both ends are referred to as end bores and a bore sandwiched by other cylinder bores on both sides is referred to as intermediate bore.

A position where the cylinder bore wall thermal insulator of the present invention is set is a groove-like cooling water channel. In many internal combustion engines, a position equivalent to a middle and lower part of the groove-like cooling water channel of the cylinder bore is a position where the speed of a piston increases. Therefore, it is desirable to insulate the middle and lower part of the groove-like cooling water channel. In FIG. 2, a position 10 near the middle between a top part 9 and a bottom part 8 of the groove-like cooling water channel 14 is indicated by a dotted line. A portion of the groove-like cooling water channel 14 in the lower side of the position 10 near the middle is referred to as middle and lower part of the groove-like cooling water channel. Note that the middle and lower part of the groove-like cooling water channel does not mean a portion below a position right in the middle between the top part and the bottom part of the groove-like cooling water channel and means a portion below the vicinity of the intermediate position between the top part and the bottom part. Depending on the structure of the internal combustion engine, the position where the speed of the piston increases is a position corresponding to a lower part of the groove-like cooling water channel of the cylinder bore. In that case, it is desirable to insulate the lower part of the groove-like cooling water channel. Therefore, it is appropriately selected to which position from the bottom part of the groove-like cooling water channel is insulated by the cylinder bore wall thermal insulator of the present invention, that is, in which position in the up-down direction of the groove-like cooling water channel the position of the upper end of the rubber member is set.

The cylinder bore wall thermal insulator of the present invention includes the insulating section for insulating the wall surface on the cylinder bore side of the groove-like cooling water channel and the supporting section to which the insulating section is fixed. The cylinder bore wall thermal insulator of the present invention is a thermal insulator for insulating the wall surface in a one-side half or a part of the wall surface on one side among all the wall surfaces on the cylinder bore side of the groove-like cooling water channel. That is, the cylinder bore wall thermal insulator of the present invention is a thermal insulator for insulating the bore walls in a one-side half or a part of the bore walls on one side among the bore walls of all the cylinder bores. Note that, in the present invention, a one-side half or a part of one side means a one-side half or a part of one side in the circumferential direction of the cylinder bore wall or the groove-like cooling water channel.

In the cylinder bore wall thermal insulator of the present invention, the bore wall insulating sections are set for each of the bore walls of the cylinder bores about to be insulated by the bore wall insulating sections. The number and a setting range of the bore wall insulating sections are selected as appropriate according to the number and insulating parts of the bore walls of the cylinder bores about to be insulated by the bore wall insulating sections. In the cylinder bore wall thermal insulator of the present invention, one bore wall insulating section may be set in one supporting section bore section, two bore wall insulating sections may be set in one supporting section bore section, or three or more bore wall insulating sections may be set in one supporting section bore section. Alternatively, these forms may be combined. Alternatively, the bore wall insulating sections may be not set in a part of the supporting section bore sections. For example, in the cylinder bore wall thermal insulators 36*a* and 36*b* shown in FIG. 5 and a cylinder bore wall thermal insulator 36*c* shown in FIGS. 23(A) and 23(B), one bore wall insulating section is set for one supporting section bore section. In the cylinder bore wall thermal insulator of the present invention, when viewed from the contact surface side, a bore wall thermal insulator may be set in entire one supporting section bore section, a bore wall thermal insulator may be set in a part of one supporting section bore section, or a bore wall insulating section may be a combination of these forms. The supporting section is a supporting member on which the bore wall insulating section is fixed and supported. The bore all insulating section is fixed to the supporting section, whereby the supporting section plays a role of deciding a position of the bore wall insulating section such that the position of the bore wall insulating section does not deviate in the groove-like cooling water channel. When viewed from above, the supporting section has a shape conforming the groove-like cooling water channel in which the cylinder bore wall thermal insulator of the present invention is set. Note that the supporting section bore section means a portion of the supporting section on the bore wall side of the cylinder bores and is a portion for one arcuate shape forming the supporting section when viewed from above.

The bore wall insulating section includes the rubber member, the rear surface pressing member, and the elastic members.

The rubber member is a member that is direct in contact with the wall surface on the cylinder bore side of the groove-like cooling water channel, covers the wall surface on the cylinder bore side of the groove-like cooling water channel, and insulates the cylinder bore wall. The rubber member is pressed against the wall surface on the cylinder bore side of the groove-like cooling water channel by the rear surface pressing member with an urging force of the elastic member. Therefore, the rubber member is molded into a shape conforming to the wall surface on the cylinder bore side of the groove-like cooling water channel i.e., an arcuate shape when viewed from above. The shape of the rubber member viewed from a side is selected as appropriate according to a portion of the wall surface on the cylinder bore side of the groove-like cooling water channel covered by the rubber member.

Examples of the material of the rubber member include rubber such as solid rubber, expanding rubber, foamed rubber, and soft rubber and silicone-based gelatinous material. Heat-sensitive expanding rubber or water-swelling rubber that can expand a rubber member portion in the groove-like cooling water channel after setting of the cylinder bore wall thermal insulator is desirable in that the rubber member can strongly come into contact with the cylinder bore wall and prevent the rubber member from being shaved when the cylinder bore wall thermal insulator is set in the groove-like cooling water channel.

Examples of a composition of the solid rubber include natural rubber, butadiene rubber, ethylene propylene diene rubber (EPDM), nitrile butadiene rubber (NBR), silicone rubber, and fluorocarbon rubber.

Examples of the expanding rubber include heat-sensitive expanding rubber. The heat-sensitive expanding rubber is a composite body obtained by impregnating a thermoplastic substance having a lower melting point than a base form material in the base form material and compressing the thermoplastic substance. The heat-sensitive expanding rubber is a material, a compressed state of which is maintained by a hardened object of the thermoplastic substance present at least in a surface layer part thereof at the normal temperature and is released when the hardened object of the thermoplastic substance is softened by heating. Examples of the heat-sensitive expanding rubber include heat-sensitive expanding rubber described in Japanese Patent Laid-Open No. 2004-143262. When the material of the rubber member is the heat-sensitive expanding rubber, the cylinder bore wall thermal insulator of the present invention is set in the groove-like cooling water channel and heat is applied to the heat-sensitive expanding rubber, whereby the heat-sensitive expanding rubber expands to be deformed into a predetermined shape.

Examples of the base form material related to the heat-sensitive expanding rubber include various polymeric materials such as rubber, elastomer, thermoplastic resin, and thermosetting resin. Specifically, examples of the base form material include natural rubber, various synthetic rubbers such as chloropropylene rubber, styrene butadiene rubber, nitrile butadiene rubber, ethylene propylene diene terpolymer, silicone rubber, fluorocarbon rubber, and acrylic rubber, various elastomers such as soft urethane, and various thermosetting resins such as hard urethane, phenolic resin, and melamine resin.

As the thermoplastic substance related to the heat-sensitive expanding rubber, a thermoplastic substance, any one of a glass transition point, a melting point, and a softening temperature of which is lower than 120° C., is desirable. Examples of the thermoplastic substance related to the heat-sensitive expanding rubber include thermoplastic resin such as polyethylene, polypropylene, polystyrene, polyvinyl chloride, polyvinylidene chloride, polyvinyl acetate, polyacrylic ester, styrene butadiene copolymer, chlorinated polyethylene, polyvinylidene fluoride, ethylene-vinyl acetate copolymer, ethylene vinyl chloride acrylate copolymer, ethylene-vinyl acetate copolymer, ethylene-vinyl acetate copolymer, nylon, acrylonitrile-butadiene copolymer, polyacrylonitrile, polyvinyl chloride, polychloroprene, polybutadiene, thermoplastic polyimide, polyacetal, polyphenylene sulfide, polycarbonate, and thermoplastic polyurethane and various thermoplastic compounds such as low-melting point glass flit, starch, solder, and wax.

Examples of the expanding rubber include water-swelling rubber. The water swelling rubber is a material obtained by adding a water-absorbing substance to rubber and is a rubber material that absorbs water and swells and has firmness for retaining an expanded shape. Examples of the water-swelling rubber include rubber materials obtained by adding water-absorbing materials such as a crosslinking substance of a polyacrylic acid neutralized product, starch acrylic acid graft copolymer cross linking substance, cross-linked carboxymethyl cellulose salt, and polyvinyl alcohol to rubber. Examples of the water-swelling rubber include water-swelling rubber containing ketimine polyamide resin, glycidyl ethers, water-absorbing resin, and rubber described in Japanese Patent Laid-Open No. 9-208752. When the material of the rubber member is the water-swelling rubber, the cylinder bore wall thermal insulator of the present invention is set in the groove-like cooling water channel and the cooling water is fed and the water-swelling rubber absorbs the water, whereby the water-swelling rubber expands to be deformed into a predetermined shape.

The foamed rubber is porous rubber. Examples of the foamed rubber include sponge-like foamed rubber having an open-cell structure, foamed rubber having a closed-cell structure, and a semi-independent foamed rubber. Examples of the material of the foamed rubber include ethylene propylene diene terpolymer, silicone rubber, nitrile butadiene copolymer, silicone rubber, and fluorocarbon rubber. An expansion ratio of the foamed rubber is not particularly limited and is selected as appropriate. It is possible adjust a water content of the rubber member by adjusting the expansion ratio. Note that the expansion ratio of the foamed rubber indicates a density ratio before and after foaming represented by ((pre-foaming density−post-foaming density)/pre-foaming density)×100.

When the material of the rubber member is a material that can contain water such as the water-swelling rubber or the foamed rubber, when the cylinder bore wall thermal insulator of the present invention is set in the groove-like cooling water channel and the cooling water is fed to the groove-like cooling water channel, the rubber member contains water. In which range the water content of the rubber member is set when the cooling water is fed to the groove-like cooling water channel is selected as appropriate according to operation conditions and the like of the internal combustion engine. Note that the water content indicates a weight water content represented by (cooling water weight/(filler weight+cooling water weight))×100.

Figure 20A:
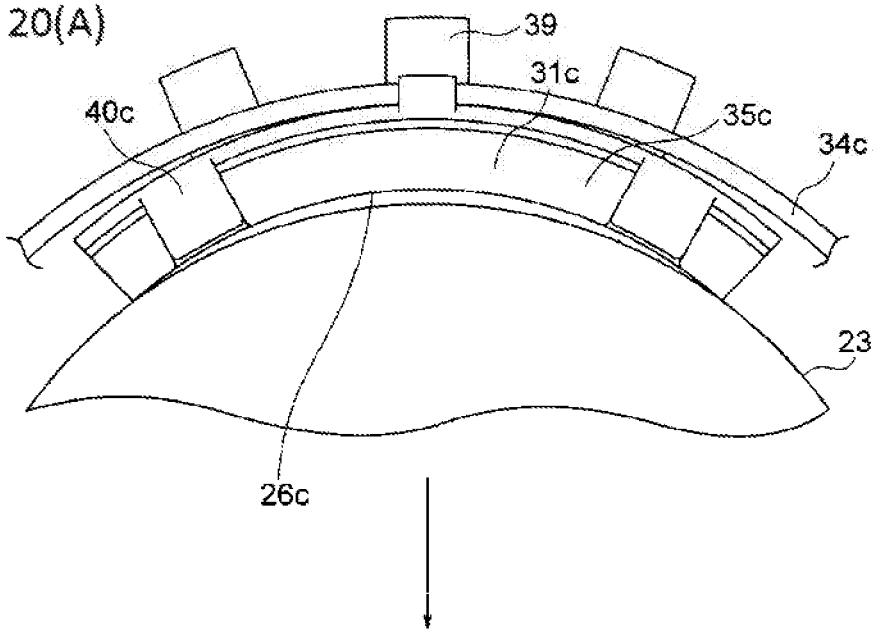
FIGS. 20(A) and 20(B) are views showing a state of expansion of the rubber member and deformation of the bore wall thermal insulator in the case in which an expanding rubber is used as a rubber member.
Figure 20B:
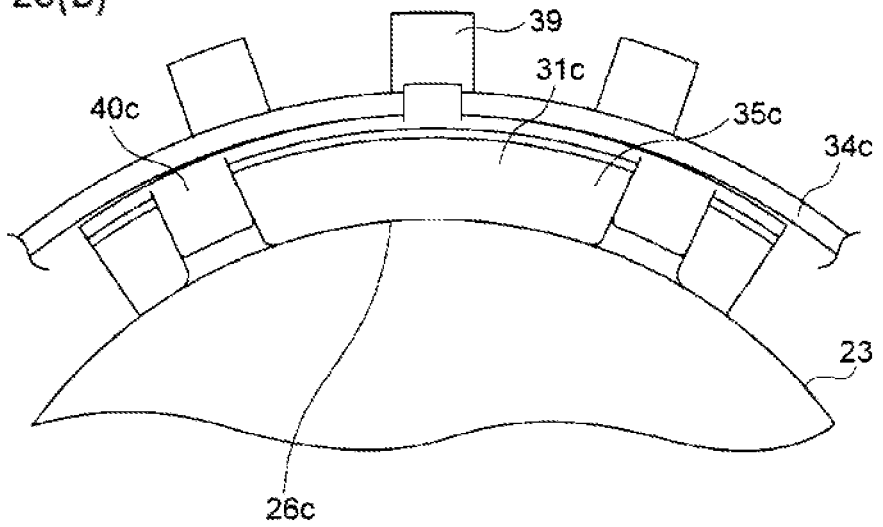

When the expanding rubber is used as the material of the rubber member, as shown in FIGS. 20(A) and 20(B), it is desirable to design the position of the surface 26*c* of the rubber member 31*c* after the expansion such that the rubber member 31*c* expands further to the bore wall side (closer to the wall surface on the cylinder bore side of the groove-like cooling water channel) than the bending sections 40*c* compared with before the expansion. In the form example shown in FIGS. 20(A) and 20(B) before the rubber member 31*c* is urged by the elastic members 39 in the groove-like cooling water channel and before the rubber member 31 expands (FIG. 20(A)), a curvature of the contact surface of the rubber member 31*c* is larger than a curvature of the bore wall 23 of the cylinder bore with which the rubber member is in contact. Therefore, there is a gap between the rubber member 31*c* and the bore wall 23. When the rubber member 31*c* is urged by the elastic members to expand from that state (FIG. 20(B)), the rubber member 31*c* expands such that the position of the surface 26*c* of the rubber member 31*c* is further on the bore wall side than the bending sections 40*c*. The center or the portion in the vicinity of the center of the bore wall insulating sections 35*c* in the arc direction is pushed by the elastic members 39 from the rear surface side, whereby portions other than the center or the vicinity of the center in the arc direction of the bore wall insulating section 35 are deformed independently from the supporting section 34*c* such that portions on both end sides in the are direction of the bore wall insulating section 35 open to the outside. In the cylinder bore wall thermal insulator of the present invention, when the curvature of the contact surface of the rubber member of the bore wall insulating section is larger than the curvature of the bore wall of the cylinder bore in contact with the rubber member, the center or the portion in the vicinity of the center in the arc direction of the bore wall insulating section is pushed by the elastic members from the rear surface side and the portions other than the center or the vicinity of the center in the are direction of the bore wall insulating section are deformed independently from the supporting section such that the portions on both the end sides in the arc direction of the bore wall insulating section open to the outside. This occurs irrespective of whether the rubber member is the expanding rubber or the rubber member is rubber that does not expand. Note that, when the rubber member of the bore wall insulating section is the expanding rubber, as the bore wall insulating section, there is also a form in which, after the cylinder bore wall thermal insulator of the present invention is set in the groove-like cooling water channel, the expanding rubber comes into contact with the cooling water or is heated to expand and comes into contact with the wall surface on the cylinder bore side of the groove-like cooling water channel.

The thickness of the rubber member is not particularly limited and is selected as appropriate.

The rear surface pressing member is formed in an arcuate shape when viewed from above. The rear surface pressing member has a shape conforming the rear surface side (a surface on the opposite side of the contact surface side) of the rubber member and a shape covering the entire rear surface side or substantially the entire rear surface side of the rubber member such that the rear surface pressing member can press the entire rubber member from the rear surface side of the rubber member. The material of the rear surface pressing member only has to be a material with which the rear surface pressing member can be deformed such that the rear surface pressing member can press the rubber member toward the wall surface on the cylinder bore side of the groove-like cooling water channel when being pressed by the elastic members from the rear surface side. The material is selected as appropriate. However, a metal plate of stainless steel, an aluminum alloy, or the like is desirable. The thickness of the rear surface pressing member only has to be thickness with which the rear surface pressing member can be deformed such that the rear surface pressing member can press the rubber member toward the wall surface on the cylinder bore side of the groove-like cooling water channel when being pressed by the elastic members from the rear surface side. The thickness of the rear surface pressing member is selected as appropriate.

The elastic members are attached to the rear surface side of the bore wall insulating section. The elastic members are members elastically deformed when the cylinder bore wall thermal insulator of the present invention is set in the groove-like cooling water channel and for urging the rear surface pressing member with an elastic force to press the rubber member toward the wall surface on the cylinder bore side of the groove-like cooling water channel.

Two or more elastic members are attached in the arc direction of the bore wall insulating section when the bore wall insulating section is viewed from above. When the elastic member is set in one place, in order to press the entire thermal insulator, the elastic member is attached to the center or the vicinity of the center of the bore wall insulating section. However, since the center or the vicinity of the center of the bore wall insulating section is fixed to the supporting section, the bore wall insulating section is pressed together with the supporting section. Therefore, the portions at the ends of the bore wall insulating section do not separate from the supporting section to be deformed independently from the supporting section. The rubber member is not pressed toward the wall surface on the cylinder bore side of the groove-like cooling water channel. Therefore, the elastic members need to be attached to at last in two places in total, that is, one place close to one end side and one place close to the other end of the bore wall insulating section such that the portions at both the ends of the bore wall insulating section separate from the supporting section to be deformed independently from the supporting section and press the rubber member toward the wall surface on the cylinder bore side of the groove-like cooling water channel. The elastic members are desirably attached to three places in total, that is one place in the center or the vicinity of the center in the arc direction of the bore wall insulating section, one place close to one end side of the bore wall insulating section, and one place close to the other end such that the entire bore wall insulating section is pressed and the portions at both the ends of the bore wall insulating section are pressed independently from the supporting section. Further, the elastic members may be attached to four or more places in the arc direction in order to improve adhesion of the rubber member of the bore wall insulating section to the wall surface on the cylinder bore side of the groove-like cooling water channel.

A form of the elastic member is not particularly limited. Examples of the form of the elastic member include a tabular elastic member, a coil-like elastic member, a leaf spring, a torsion spring, and elastic rubber. The material of the elastic member is not particularly limited. However, stainless steel (SUS), an aluminum alloy, or the like is desirable because LLC resistance is high and strength is high. As the elastic member, a metal elastic member such as a metal leaf spring, a coil spring, a leaf spring, or a torsion spring is desirable.

Figure 24A:
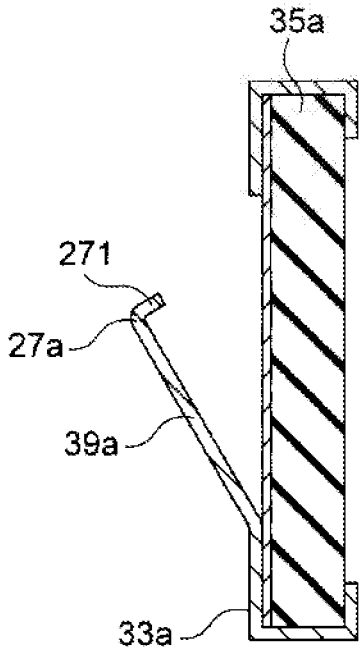
FIGS. 24(A) to 24(C) are schematic views showing a form example of the bore wall insulating section.
Figure 24B:
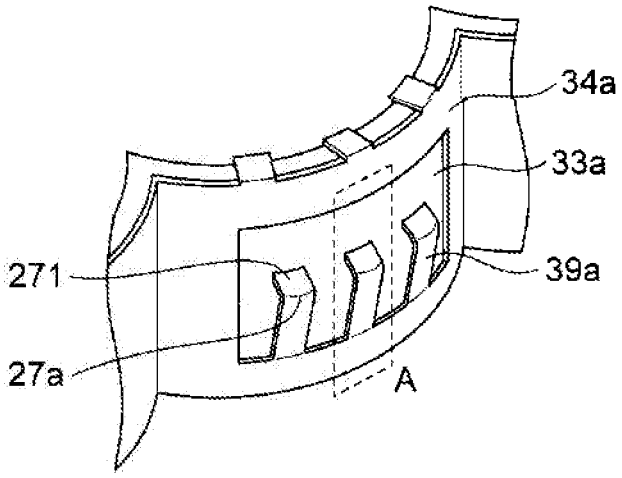
Figure 24C:
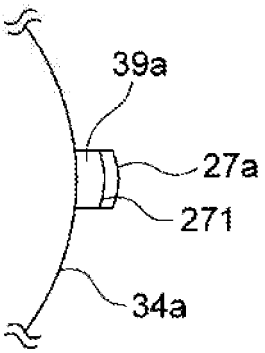

As the elastic member, it is desirable that a portion in contact with the wall surface on the opposite side of the wall surface on the cylinder bore side of the groove-like cooling water channel and the vicinity of the portion are molded into a curved surface shape swelling to the wall surface on the opposite side of the wall surface on the cylinder bore side of the groove-like cooling water channel because it is possible to prevent the wall surface on the opposite side of the wall surface on the cylinder bore side of the groove-like cooling water channel from being damaged by a contact portion with the wall surface of the elastic member when the cylinder bore wall thermal insulator of the present invention is inserted in to the groove-like cooling water channel. Examples of such a form example include a form example shown in FIGS. 24(A) to 24(C). In FIGS. 24(A) to 24(C), metal-leaf-spring attaching members 33*a*, to which metal leaf springs 39*a* are attached, are provided on the rear surface side of the bore wall thermal insulator 35*a*. As shown in FIG. 24(A), a distal end portion 27*a* of the metal leaf spring 39*a* is formed by bending a folding-back section 271 to the bore wall thermal insulator 35*a* side. As shown in FIGS. 24(B) and (B), the distal end portion 27*a* is formed in a curved surface shape swelling with respect to a wall surface in contact with the distal end portion 27*a* (a wall surface on the opposite side of the wall surface on the cylinder bore side of the groove-like cooling water channel). That is, in the form example shown in FIGS. 24(A) to 24(C), in the metal leaf spring, which is the elastic member, a distal end portion in contact with the wall surface on the opposite side of the wall surface on the cylinder bore side of the groove-like cooling water channel is formed in a curved surface shape swelling with respect to the wall surface on the opposite side of the wall surface on the cylinder bore side of the groove-like cooling water channel. Note that FIG. 24(A) is an end face view of the bore wall insulating section 35*a* and is an end face view of the bore wall insulating section 35*a* perpendicularly cut in the center in the arc direction. FIG. 24(B) is a view of the supporting section bore section, to which the bore wall insulating section 35*a* is fixed, viewed from obliquely above on the rear surface side. FIG. 24(C) is a view of a portion A, which is surrounded by a dotted line in FIG. 24(B), viewed from above.

In the cylinder bore wall thermal insulator of the present invention, a form, a shape, a size, a setting position, a setting number, and the like of the elastic members are selected as appropriate according to the shape and the like of the groove-like cooling water channel such that the rubber member is urged by an appropriate pressing force by the elastic members when the thermal insulator is set in the groove-like cooling water channel.

Figure 21:
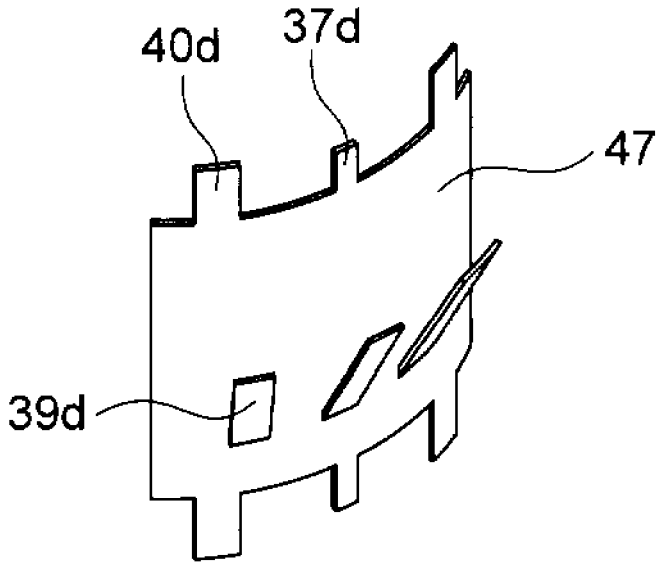
FIG. 21 is a perspective view of a form example of a rear surface pressing member.

In the cylinder bore wall thermal insulator 36*a* shown in FIG. 5, the metal-leaf-spring attaching member and the metal leaf spring, which is the elastic member, are integrally molded and the rubber member and the rear surface pressing member are fixed to the metal-leaf-spring attaching member in which the metal leaf spring is formed, whereby the elastic member is attached to the bore wall insulating section. However, a method of attaching the elastic member to the bore wall insulating section is not particularly limited. Examples of other methods include a method of welding a metal elastic member such as a metal leaf spring, a metal coil spring, a leaf spring, or a torsion spring to the rear surface pressing member made of a metal plate to fix the rubber member to the rear surface pressing member to which the elastic member is welded. In a form example shown in FIG. 21, metal leaf springs 39*d* made of longitudinally long rectangular metal plates are welded to the rear surface pressing member 47 in which bending sections 40*d* made of a metal plate and for fixing rubber member to upper and lower parts and bending sections 37*d* for fixing the thermal insulator to the supporting section are formed.

Figure 25:
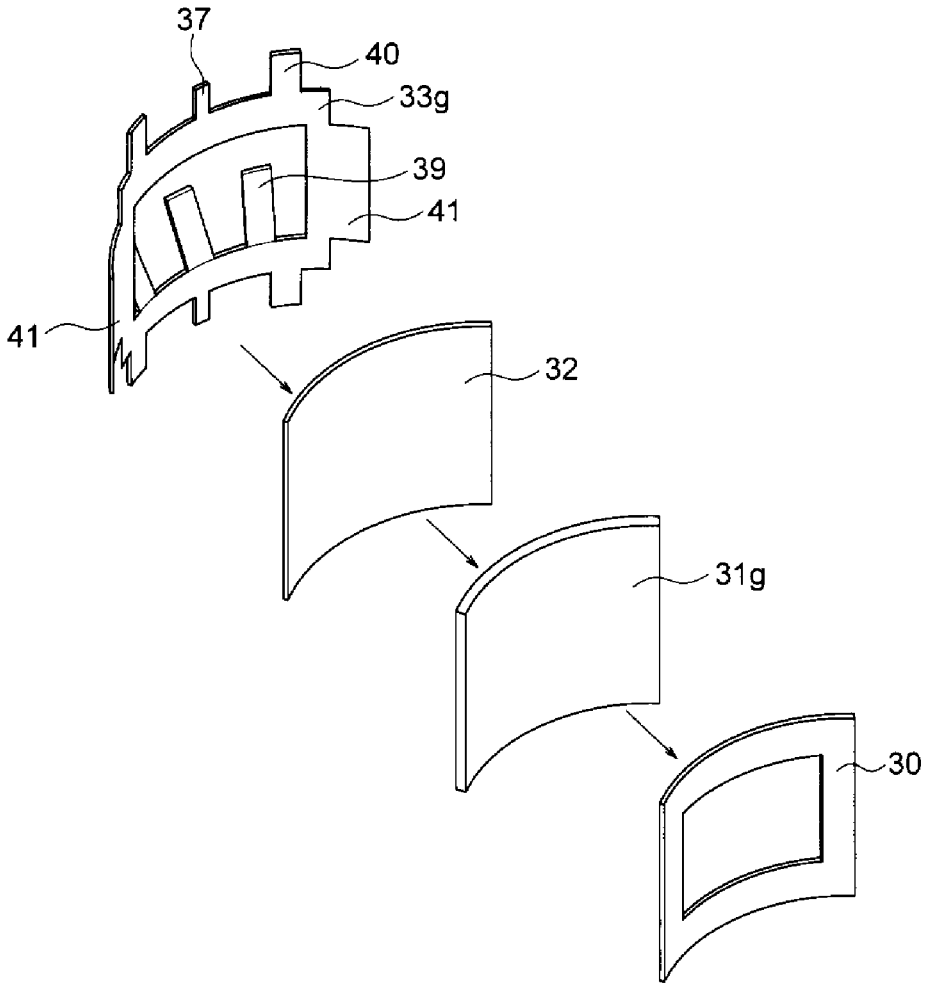
FIG. 25 is a schematic perspective view showing a state in which a form example of the bore wall insulating section is manufactured.
Figure 26:
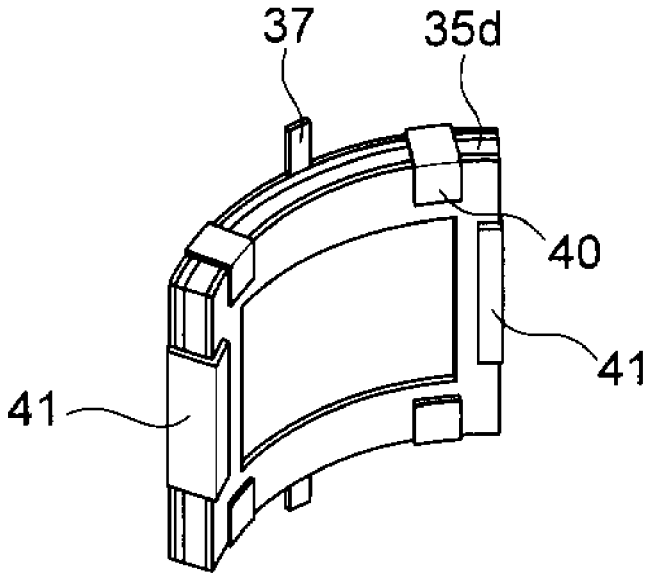
FIG. 26 is a schematic perspective view showing a form example of the bore wall insulating section shown in FIG. 25.

Examples of a form example of the bore wall insulating sections include form examples shown in FIG. 25 and FIG. 26. As shown in FIG. 25, the rear surface pressing member 32 and a metal-leaf-spring attaching member 33*g*, to which the metal leaf springs 39 are attached and in which the bending sections 40, the bending sections 41, and the bending sections 37 are formed, are joined to a rubber member 31*g*, which is expanding rubber, in order and a hollow square-shaped backing plate 30 formed of a hollow square-shaped metal thin plate is further joined to the contact surface side of the rubber member 31*g*. Subsequently, the bending sections 40 and the bending sections 41 are bent. As shown in FIG. 26, the rear surface pressing member 32, the rubber member 31*g*, and the hollow square-shaped backing plate 30 are held by the bending sections 40 and the bending sections 41, whereby the rear surface pressing member 32, the rubber member 31*g*, and the hollow square-shaped backing plate 30 are fixed to the metal-leaf-spring attaching member 33*g* to manufacture a bore wall insulating section 35*d*. That is, examples of the bore wall insulating section include a bore wall insulating section including the rubber member, which is the expanding rubber, the rear surface pressing member, the elastic members, and the hollow square backing plate disposed on the contact surface side of the rubber member and formed of the hollow square-shaped metal plate. The hollow square-shaped backing plate has a hollow square shape when viewed from the contact surface side. Therefore, the hollow square-shaped plate is in contact with ends on four sides of the surface of the rubber member. In other words, the hollow square-shaped backing plate includes a rectangular opening on the inner side. When the rubber member, which is the expanding rubber, expands, the expanding rubber projects further to the outside than the backing plate from the portion of this opening. The surface of the projecting portion is formed as the contact surface. In the bore wall insulating section including the hollow square-shaped backing plate, the bending sections for fixing the rubber member do not come into direct contact with the rubber member. The hollow square-shaped backing plate having an extremely large contact area compared with the bending sections comes into contact with the rubber member. Therefore, it is possible to prevent the rubber member from being easily torn when the bending sections having a small contact area with the rubber member bites into the rubber member.

In the cylinder bore wall thermal insulator of the present invention, the bore wall insulating sections are fixed to the supporting section such that the contact surface of the rubber member faces the wall surface on the cylinder bore side of the groove-like cooling channel and the contact surface of the rubber member can come into contact with the wall surface on the cylinder bore side of the groove-like cooling water channel. On the rear surface side of the cylinder bore wall thermal insulator of the present invention, the elastic members attached to the bore wall insulating sections project toward the opposite side of the rubber member through openings of the supporting section such that the elastic members can come into contact with the wall surface on the opposite side of the wall surface on the cylinder bore side of the groove-like cooling water channel.

The number of bore wall insulating sections fixed to the supporting section is selected as appropriate according to the number of bore walls of the cylinder bores about to be insulated by the bore wall insulating sections.

The supporting section is a member to which the bore wall insulating sections are fixed such that the positions of the bore wall insulating sections in the groove-like cooling water channel do not deviate. Therefore, the supporting section has a shape conforming to the groove-like cooling water channel in the setting position of the cylinder bore wall thermal insulator of the present invention. The supporting section continues from one end side to the other end side. When viewed from above, the supporting section is molded into a shape of a continuous plurality of arcs. Examples of the material of the supporting section include a metal plate of stainless steel (SUS), an aluminum alloy, or the like. Note that, when the supporting section is made of the metal plate, the supporting section may be manufactured by molding one metal plate or may be manufactured by connecting a plurality of metal plates if the supporting section continues from one end side to the other end side.

In the supporting section, the opening sections, through which the elastic members attached to the bore wall insulating sections present further on the wall surface side on the cylinder bore side of the groove-like cooling water channel than the supporting section pass, are formed such that the elastic members can come into contact with the wall surface on the opposite side of the wall surface on the cylinder bore side of the groove-like cooling water channel.

Figure 22:
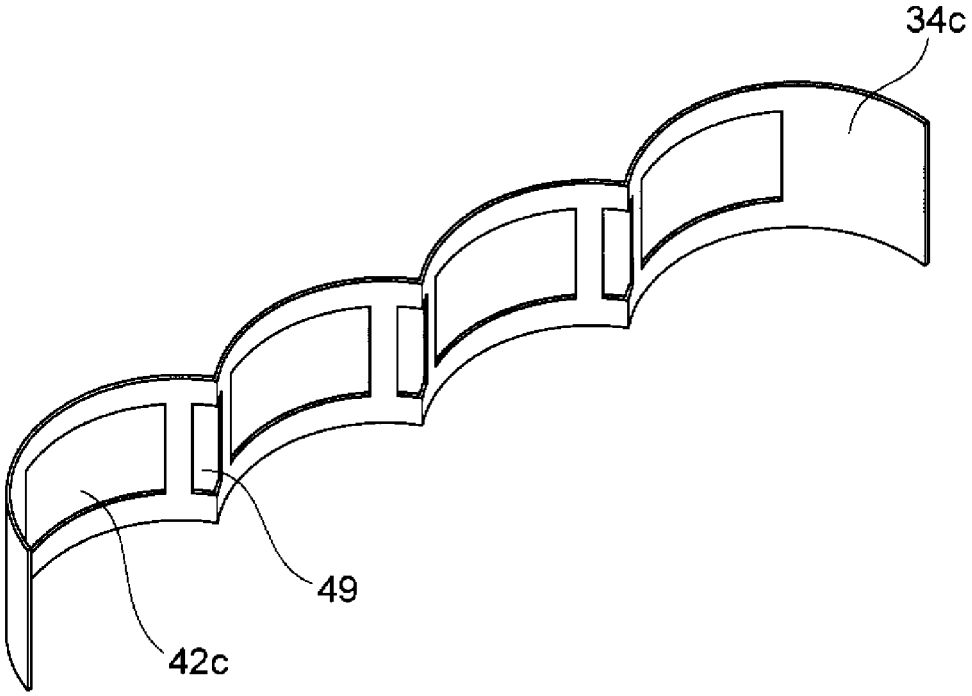
FIG. 22 is a perspective view of a form example of the supporting section.

In the cylinder bore wall thermal insulator 36*a* shown in FIG. 5, portions 48 of the supporting section 34*a* in positions opposed to boundaries among the bore walls of the cylinder bores and the vicinities of the boundaries on the wall surface on the cylinder bore side of the groove-like cooling water channel are closed. However, the thermal insulator 36*a* is not limited to this. As in a form example shown in FIG. 22, openings 49 may be formed in portions of the supporting section 34*c* located in the boundaries among the bore walls of the cylinder bores and the vicinities of the boundaries on the wall surface on the cylinder bore side of the groove-like cooling water channel such that the cooling water on the rear surface side of the cylinder bore wall thermal insulator can flow to the inner side of the cylinder bore wall thermal insulator and flow into the boundaries among the bore walls of the cylinder bores and the vicinities of the boundaries on the wall surface on the cylinder bore side of the groove-like cooling water channel. Openings are formed in portions of the supporting section located in the boundaries among the bore walls of the cylinder bores and the vicinities of the boundaries on the wall surface on the cylinder bore side of the groove-like cooling water channel. Therefore, it is possible to feed, from the openings, the cooling water into the boundaries among the bore walls of the cylinder bores and the vicinities of the boundaries on the wall surface on the cylinder bore side of the groove-like cooling water channel and cool the boundaries among the bore walls of the cylinder bores and the vicinities of the boundaries on the wall surface on the cylinder bore side of the groove-like cooling water channel. Consequently, it is possible to adjust the temperature of inter-bore walls where temperature rises.

In the cylinder bore wall thermal insulator of the present invention, only the center or the vicinity of the center in the arc direction viewed from above of the bore wall insulating section is fixed to the supporting section. Therefore, in the cylinder bore wall thermal insulator of the present invention, portions other than the center or the vicinity of the center in the arc direction in the bore wall insulating section are not fixed to the supporting section. Therefore, when being pushed by the elastic members from the rear surface side, the portions other than the center or the vicinity of the center in the arc direction of the bore wall insulating section can be deformed to separate from the supporting section and move toward the wall surface on the cylinder bore side of the groove-like cooling water channel. Alternatively, when the portion in the center or the vicinity of the center in the arc direction of the bore wall insulating section is pushed by the elastic members from the rear surface side, the portions other than the center or the vicinity of the center in the arc direction of the bore wall insulating section can be deformed independently from the supporting section such that the portions on both the end sides in the arc direction of the bore wall insulating section open to the outside.

Consequently, in the cylinder bore wall thermal insulator of the present invention, in manufacturing of the thermal insulator of the cylinder bore or manufacturing of the cylinder block, even if the curvature of the contact surface of the rubber member of the bore wall insulating section is smaller than the curvature of the bore surface of the cylinder with which the rubber member is in contact, the portions other than the center or the vicinity of the center in the arc direction of the bore wall insulating section are pushed by the elastic members from the rear surface side to be deformed to separate from the supporting section and move toward the wall surface on the cylinder bore side of the groove-like cooling water channel and the rubber member can adhere to the wall surface on the cylinder bore side of the groove-like cooling water channel. Therefore, adhesion of the rubber member to the wall surface on the cylinder bore side of the groove-like cooling water channel is improved. Alternatively, even if the curvature of the contact surface of the rubber member of the bore wall insulating section is larger than the curvature of the bore wall of the cylinder bore with which the rubber member is in contact, the portions on both the end sides in the arc direction of the bore wall insulating section are deformed to open to the outside and the rubber member can adhere to the wall surface on the cylinder bore side of the groove-like cooling water channel. Therefore, adhesion of the rubber member to the wall surface on the cylinder bore side of the groove-like cooling water channel is improved.

In particular, when expanding rubber such as heat-sensitive expanding rubber or water-swelling rubber is used as the rubber member of the cylinder bore wall thermal insulator of the present invention, even if machining of the contact surface of the rubber member before expansion is accurately performed, because of unevenness of an expansion amount at the time when the rubber member is expanded, the shape of the contact surface of the rubber member after the expansion sometimes deviates from the surface shape of the wall surface on the cylinder bore side of the groove-like cooling water channel to which the contact surface adheres. Even in such a case, in the cylinder bore wall thermal insulator of the present invention, by being pushed by the elastic members from the rear surface side, the portions other than the center or the vicinity of the center in the arc direction of the bore wall insulating section are deformed to separate from the supporting section and move toward the wall surface on the cylinder bore side of the groove-like cooling water channel or the portions on both the end sides in the arc direction of the bore wall insulating section are deformed to open to the outside and the rubber member can adhere to the wall surface on the cylinder bore side of the groove-like cooling water channel. Therefore, adhesion of the rubber member with the wall surface on the cylinder bore side of the groove-like cooling water channel is improved.

Note that, in FIGS. 19(A) and 19(B), for explanation of the effects of the present invention, a figure (FIG. 19(A)) is used in which, in the entire both end sides of the insulating section, a large gap is formed between the contact surfaces on both the end sides of the rubber member and the bore walls. However, actually, such a large machining error does not occur. However, actually, a small gap is formed or the contact surface of the rubber member and the bore wall are partially separated because of a machining error.

In the cylinder bore wall thermal insulator of the present invention, a range in which the bore wall insulating section is fixed to the supporting section, specifically, the length of the fixing portion in the arc direction viewed from above and the length of the fixing portion in the up-down direction viewed from a side are selected as appropriate in a range in which the effects of the present invention are achieved. For example, as in the form example shown in FIG. 5, the bore wall insulating section can be fixed to the supporting section only by the vicinity of the center in the arc direction of the bore wall insulating section viewed from above and the upper end side and the lower end side of the bore wall insulating section viewed from a side.

As in the form example shown in FIG. 5, the cylinder bore wall thermal insulator of the present invention can include the cooling-water-flow partitioning member on one end side. The cylinder bore wall thermal insulator of the present invention can include, in the supporting section, a member for preventing the entire thermal insulator from deviating in the upward direction, for example, a cylinder head contact member attached to the upper side on both the ends of the supporting section, the upper end of the cylinder head contact member being in contact with a cylinder head or a cylinder head gasket. The cylinder bore wall thermal insulator of the present invention can include other members and the like for adjusting the flow of the cooling water.

Figure 23A:
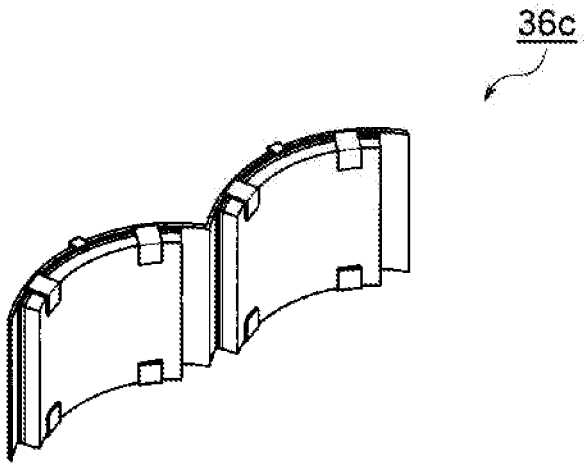
FIGS. 23(A) and 23(B) are schematic perspective views showing a form example of the cylinder bore wall thermal insulator of the present invention.
Figure 23B:
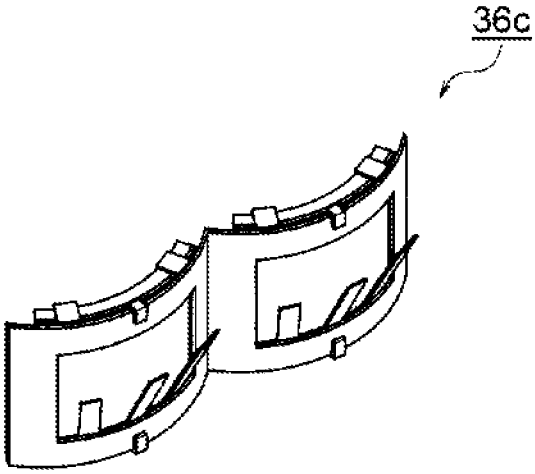

The cylinder bore wall thermal insulator 36*a* shown in FIG. 5 is the thermal insulator for insulating the bore walls on the one-side half among all the cylinder bore walls of the cylinder block 11 shown in FIG. 4. However, examples of the cylinder bore wall thermal insulator of the present invention include the thermal insulator for insulating the bore walls in a part on one side among all the cylinder bore walls as in the form example shown in FIGS. 23(A) and 23( ). The cylinder bore wall thermal insulator 36*c* in FIGS. 23(A) and 23(B) is a thermal insulator for insulating a part of the bore walls 21 a on the one-side half of the cylinder block 11 shown in FIG. 4, that is, the bore walls of the cylinder bores 12*b*1 and 12*b*2. That is, the cylinder bore wall thermal insulator of the present invention may be a thermal insulator for insulating the bore walls in a one-side half among all the cylinder bore walls of the cylinder block or may be a thermal insulator for insulating a part of the bore walls of on one side among all the cylinder bore walls of the cylinder block. Note that FIGS. 23(A) and 23(B) are schematic perspective views of a form example of the cylinder bore wall thermal insulator of the present invention. FIG. 23(A) is a perspective view of the thermal insulator viewed from obliquely above on the inner side. FIG. 23(B) is a perspective view of the thermal insulator viewed from obliquely above on the outer side.

An internal combustion engine according to a first aspect of the present invention is an internal combustion engine in which the cylinder bore wall thermal insulator of the present invention for insulating the wore walls in a one-side half among all the cylinder bore walls is set on both of the wall surface on one one-side half side and the wall surface on the other one-side half side among all the wall surfaces on the cylinder bore side of the groove-like cooling water channel. The internal combustion engine of the present invention adopts a form for insulating the entire circumferential direction of the cylinder bore wall with the cylinder bore wall thermal insulator.

An internal combustion engine according to a second aspect of the present invention is an internal combustion engine in which the cylinder bore wall thermal insulator of the present invention for insulating the wore walls in a one-side half among the cylinder bore walls is set on only the wall surface on either one one-side half side among all the wall surfaces on the cylinder bore side of the groove-like cooling water channel. The internal combustion engine according to the second aspect of the present invention adopts a form for providing the cylinder bore wall thermal insulator only on ether one one-side half side among all channels of the groove-like cooling water channel and not providing the cylinder bore wall thermal insulator in the groove-like cooling water channel on the other one-side half side to thereby insulate, with the cylinder bore wall thermal insulator, only the wall surface on one one-side half side among all the wall surfaces on the cylinder bore side of the groove-like cooling water channel.

An automobile of the present invention is an automobile including the internal combustion engine according to the first aspect or the second aspect of the present invention.

INDUSTRIAL APPLICABILITY

According to the present invention, since it is possible to improve adhesion of the thermal insulator to the wall surface on the cylinder bore side of the groove-like cooling water channel of the cylinder block, it is possible to improve a heat retaining property of the wall surface on the cylinder bore side of the groove-like cooling water channel. Therefore, since it is possible to reduce a difference in a deformation amount between the upper side and the lower side of the cylinder bore wall of the internal combustion engine, it is possible to reduce the friction of the piston. Therefore, it is possible to provide a fuel-saving internal combustion engine.

REFERENCE SIGNS LIST

8 bottom part
9 top part
10 position near the middle
11 cylinder block
12 bore
12*a*1, 12*a*2 end bore
12*b*1, 12*b*2 intermediate bore
13 cylinder bore wall
14 groove-like cooling water channel
15 cooling water supply port
16 cooling water discharge port
17 wall surface on the cylinder bore side of the groove-like cooling water channel 14
17*a*, 17*b* wall surface in the one-side half
18 wall surface on the opposite side of the wall surface on the cylinder bore side of the groove-like cooling water channel 14
21*a*, 21*b* bore wall in a one-side half
23*a*1, 23*a*2, 23*b*1, 23*b*2 bore wall of a cylinder bore
26, 26*c* contact surface
27 distal end
31, 31*c* rubber member
32, 47 rear surface side pressing member
34*a*, 34*b*, 34*c* supporting section
35, 35*c* bore wall insulating section
36*a*, 36*b*, 36*c* cylinder bore wall thermal insulator
37, 40, 40*c* bending section
38 cooling-water-flow partitioning member
39 metal leaf spring
42, 49 opening
41, 43 metal plate
45, 46 punched product of the metal plate
48 positions opposed to boundaries among the bore walls of the cylinder bores and the vicinities of the boundaries on the wall surface on the cylinder bore side of the groove-like cooling water channel
191 inter-bore section
192 boundary between bore walls of cylinder bores of the wall surface on the cylinder bore side of the groove-like cooling water channel

The invention claimed is:

1. A cylinder bore wall thermal insulator configured to be set in a groove-like cooling water channel of a cylinder block of an internal combustion engine including cylinder bores and for insulating bore walls in a one-side half among the bore walls of all the cylinder bores or a part of the bore walls on one side among the bore walls of all the cylinder bores, the thermal insulator comprising:

bore wall insulating sections having an arcuate shape when viewed from above and being configured to insulate a wall surface on the cylinder bore side of the groove-like cooling water channel; and a supporting section having a shape conforming to a shape of the groove-like cooling water channel in a setting position of the thermal insulator, the bore wall insulating sections being fixed to a cylinder bore side of the supporting section, wherein the bore wall insulating sections include elastic members disposed on a cylinder bore side of the supporting section, pressing members disposed on a cylinder bore side of the elastic members, and rubber members disposed on a cylinder bore side of the pressing members, wherein the rubber members are configured to be in contact with the wall surface on the cylinder bore side of the groove-like cooling water channel and to cover for covering the wall surface on the cylinder bore side of the groove-like cooling water channel;

wherein the pressing members are configured to press the rubber members toward the wall surface on the cylinder bore side of the groove-like cooling water channel;

wherein the elastic members are configured to urge the pressing members to press the rubber members toward the wall surface on the cylinder bore side of the groove-like cooling water channel, and wherein the bore wall insulating sections are fixed to the supporting section only at positions which correspond to a center or a vicinity of the center of the arcuate shape, when viewed from above, of the bore wall insulating sections.

2. The cylinder bore wall thermal insulator according to claim 1, wherein the rubber member is heat-sensitive expanding rubber or water-swelling rubber.

3. The cylinder bore wall thermal insulator according to claim 1, wherein the thermal insulator includes an opening in a position of the supporting section opposed to a boundary between bore walls of the cylinder bores and a vicinity of the boundary.

4. The cylinder bore wall thermal insulator according to claim 1, wherein the cylinder bore wall thermal insulator is a thermal insulator for insulating the bore walls in a one-side half among the bore walls of all the cylinder bores.

5. An internal combustion engine, wherein the cylinder bore wall thermal insulator according to claim 4 is set on both of the wall surface on one one-side half side and the wall surface on another one-side half side among all the wall surfaces on the cylinder bore side of the groove-like cooling water channel.

6. An internal combustion engine, wherein the cylinder bore wall thermal insulator according to claim 4 is set on only the wall surface on either one one-side half side among all the wall surfaces on the cylinder bore side of the groove-like cooling water channel.

7. An automobile comprising the internal combustion engine according to claim 5.

* * * * *